US009273434B2

(12) United States Patent
Poff

(10) Patent No.: US 9,273,434 B2
(45) Date of Patent: Mar. 1, 2016

(54) PRE-FABRICATED MODULAR BOAT DOCK ASSEMBLY

(71) Applicant: Jack Allen Poff, Beecher City, IL (US)

(72) Inventor: Jack Allen Poff, Beecher City, IL (US)

(73) Assignee: B&R Construction, Inc., Taylorville, IL (US)

( * ) Notice: Subject to any disclaimer, the term of this patent is extended or adjusted under 35 U.S.C. 154(b) by 101 days.

(21) Appl. No.: 14/161,317

(22) Filed: Jan. 22, 2014

(65) Prior Publication Data

US 2015/0204033 A1 Jul. 23, 2015

(51) Int. Cl.

| | |
|---|---|
| ***E01D 15/24*** | (2006.01) |
| ***E01D 15/00*** | (2006.01) |
| ***E02B 3/06*** | (2006.01) |

(52) U.S. Cl.

CPC ..... *E01D 15/005* (2013.01); *E01D 15/24* (2013.01); *E02B 3/068* (2013.01); *B63B 2737/00* (2013.01)

(58) Field of Classification Search

USPC ..... 405/218

See application file for complete search history.

(56) References Cited

U.S. PATENT DOCUMENTS

| | | | | |
|---|---|---|---|---|
| 3,763,808 | A * | 10/1973 | Smith, Sr. | 114/266 |
| 4,050,257 | A * | 9/1977 | Parks et al. | 405/218 |
| 2009/0090289 | A1 * | 4/2009 | Lemonides | 114/230.1 |
| 2009/0181837 | A1 * | 7/2009 | Erlenmaier et al. | 483/13 |

* cited by examiner

*Primary Examiner* — Frederick L Lagman
*Assistant Examiner* — Kyle Armstrong
(74) *Attorney, Agent, or Firm* — Craig & Craig, LLC; R. Sean Hocking; John F. Watson

(57) ABSTRACT

An assembly for budding a pre-fabricated modular boat dock structure is disclosed. The assembly is designed to be modular so it can be fabricated in a shop environment and then installed by assembling it on site. The assembly is further designed to enable the individual component modules to be powder coated prior to installation so that the pre-fabricated modular boat dock will be rust resistant and have a much longer expected lifespan than a custom boat dock which is built on site would have. The pre-fabricated modular boat dock structure has a pleasing aesthetic appearance after having been powder coated and is useful in extending the life of a boat dock structure used to shelter boats stored immediately adjacent to a body of water.

2 Claims, 21 Drawing Sheets

PRE-FABRICATED MODULAR BOAT DOCK ASSEMBLY

BACKGROUND OF THE INVENTION

This invention relates generally to dock structures; and more particularly, to a modular dock structure that enables its modular elements to be pre-fabricated and powder-coated.

The use of dock structures in and around bodies of water is well known. In the prior art, dock structures have been constructed from a variety of materials, including wood, steel, aluminum, and synthetic fibrous materials. Generally, a dock is a fixed structure which is located near a body of water and commonly extends from a mounting area on a and mass into the body of water at the periphery of the body of water. It is commonly known that dock structures are used to enable pedestrians to physically access a location above a body of water without having to enter the body of water itself. Often, the use of a dock structure is associated with the mooring of a pleasure boat, recreational watercraft, or other types of watercraft which, due to their construction, cannot easily be extracted from a body of water, but are simultaneously difficult to access from a fixed point on the surface of the earth that is not covered in water.

In the prior art, dock structures have been constructed such that watercraft of all types can be moored to them and so that pedestrians can access the watercraft at a location above a body of water where the depth of the body of water is sufficient to permit a subject watercraft to be moored such that its hull will not contact the surface of the earth beneath the water which buoys it.

Due to the nature of water, it is well known that the materials from which dock structures have been fabricated are highly subject to deterioration, weathering, and other natural phenomena of decomposition. Dock structures constructed of wood are subject to rotting and decomposition of the wood from which they are constructed. Dock structures made of steel are subject to the oxidation process, which is hastened in the presence of water and salt water. Aluminum structures, while more resistant to oxidation processes, are lighter weight and thus less resistant to structural damage due to the application of force (wind, impact damage, and ice) than steel constructed docks. Docks constructed of synthetic, fibrous materials are more brittle than steel constructed docks and are more susceptible to structural impact damage.

In general, steel is a desirable material for use in the construction of boat docks, primarily due to its strength and elasticity in comparison with other materials commonly used in the construction of boat docks. However, steel is highly susceptible to oxidation which severely limits the life-span of dock structures constructed from steel.

In the prior art of boat dock construction, the classical means of fabricating a boat dock has been to use steel framing members and elements which are custom welded into a frame structure at the site where a boat dock is assembled and installed immediately adjacent to a body of water. Such processes necessitate the use of steel framing members and elements which are welded together and because of the nature of steel are subject to deterioration due to oxidation. Classically, such steel frame constructed boat docks may be painted or otherwise covered to delay oxidation, but suffer from the eventuality that such steel frame construction will be compromised by oxidation. Paint is easily damaged, leading the underlying steel to become exposed rather easily. The use of galvanized steel has likewise been used in the prior art, but produces an unflattering appearance that is much less pleasing to the eye than a powder coated finish. Further, the custom fabrication of a boat dock, on site, is labor intensive.

The claimed Pre-Fabricated Modular Boat Dock Assembly enables the modular elements of the frame for the assembly to be created, and mass produced, in a shop or factory setting. Because of the modular construction, the individual modules are able to be powder coated in advance of installation and then assembled on site without the need of weldments to connect the modular framing members and elements. The claimed design enables the modular framing members and elements to be attached to one another using standard fasteners, such as nuts and bolts, resulting in a boat dock structure that is entirely powder coated and extremely resistant to oxidation and deterioration while simultaneously having a pleasant, finished appearance. Powder coating is not easily damaged by the types of stresses and damage to which boat dock structures are commonly subject. Thus, constructing a modular boat dock that has modular framing members and elements that are capable of being powder coated before installation is highly desirable.

It is a primary object of this invention to provide an improved dock structure.

Another primary object of the invention is to provide an improved modular dock structure utilizing uniformly fabricated structural members.

Yet another object of this invention is to provide an improved modular dock structure that is capable of being effectively powder coated prior to assembly and installation.

BRIEF SUMMARY OF THE INVENTION

The present invention includes a modular dock structure that can employ a variable number of dock structure modules to construct a modular dock structure containing bays in which various watercraft can be stationed while not in active use. The basic configuration of the dock structure module which forms the basis for the modular dock structure utilizes two or more walkway modules which are spaced apart to define an empty space or bay between the opposing walkway modules between which a watercraft can be positioned. Extending upward from the walkway modules are vertical side modules which form a superstructure above the walkway modules and are connected by transverse upper cross members which connect the opposing vertical side modules together to form a rectangular configuration elevated above the walkway modules upon which a roof can be constructed. The roof provides a shelter to any watercraft stationed between the adjacent walkway modules. In its simplest form, the dock structure module consists of two walkway modules, two vertical side modules, one on the left and one on the right, and two upper cross members all of which modular members are connected by a series of couplers. In the simplest formulation, two single rear tube couplers are used on the landward side of the dock structure module and two single front tube couplers are used on the waterward side of the dock structure module to join the two upper cross members and two vertical side modules into the rectangular shape upon which a roof can be positioned.

A dock structure module then can be mounted upon various types of piling driven into the bed of a body of water or into the earth. One aspect of the invention is the novel modular construction that is able to be produced in a shop or factory setting rather than but as a custom project on site. The novel modular construction of the dock structure module is of sufficiently small size that each individual module and coupler element of the dock structure module can be powder coated prior to transporting the modular elements to a job site for installation and assembly. The novel design of the dock structure module enables it to use no weldments on the powder coated finish at the time it is assembled on-site, so that powder coating applied to the dock structure module is not destroyed or damaged by the welding process because all of the involved modular elements of the dock structure module are assembled with nuts and bolts or other mechanical fasteners that do not damage or destroy the integrity of the powder coating applied to the modular elements of the dock structure module.

The modular elements can be cut to predetermined lengths so they can be pre-fabricated and constructed in an efficient and cost effective way so as to avoid the labor intensive nature of building a custom sized dock structure on site.

The several modular elements of the dock structure module can all be fabricated from steel and powder coated to resist corrosion, oxidation and deterioration due to the elements and other impact damage. It is a purpose of the invention to provide the ability to powder coat the steel, modular members and elements of the dock structure module which cannot be done effectively in applications where a dock structure is custom built on site. It is likewise a purpose of the invention to provide a powder coated finish to the steel, modular members and elements of the dock structure module so that any weldments that are made in the structure are hidden from view and therefore the powder coating that is on the visible portion of the dock structure module is not disrupted or damaged by oxidation processes, and does not need to be maintained with the regularity that a painted surface would require.

The modular dock structure comprised of one or more dock structure modules can be finished with other adjacent structures (storage room, boat house, etc.) to have a pleasing aesthetic appearance. It is the intent of the design to provide a berth upon which to construct a roof structure to protect the walkways and watercraft stationed between the walkways from the elements, weather, etc. Similarly, pre-fabricated concrete, tile, wood or other decking can be affixed to the upper most surface of a walkway module to provide a stable structure upon which persons can walk and rest a variety of implements, while providing access to watercraft positioned in the bay area of the dock structure module.

The modular design of the dock structure module enables a virtually unlimited number of associated dock structure modules to be linked together to create a modular dock structure suitable for stationing a multitude of watercraft. Another aspect of the modular dock structure is that dock structure modules can be configured with a boat hoist. Such a boat hoist, in one embodiment, is retained by angle iron tracks affixed to opposing sides of each vertical side module. In the preferred embodiment, the upper side member of each vertical side module is a steel I-beam and the lower flange of the I-beam is used to support and retain a boat hoist that is adjustable longitudinally along the length of the upper side member enabling such a boat hoist to be adjusted for the purpose of balancing watercraft lifted on the boat hoist without the necessity of welding or drilling on the dock structure module or vertical side module and thus without damaging powder coating applied to the dock structure module. Either configuration enables a watercraft stationed between adjacent walkway modules to be lifted from the body of water in which the given dock structure module is located so that such watercraft can be stored, cleaned, and removed from the body of water and accessed via the adjacent walkway modules.

DETAILED DESCRIPTION OF THE INVENTION

Figure 1:
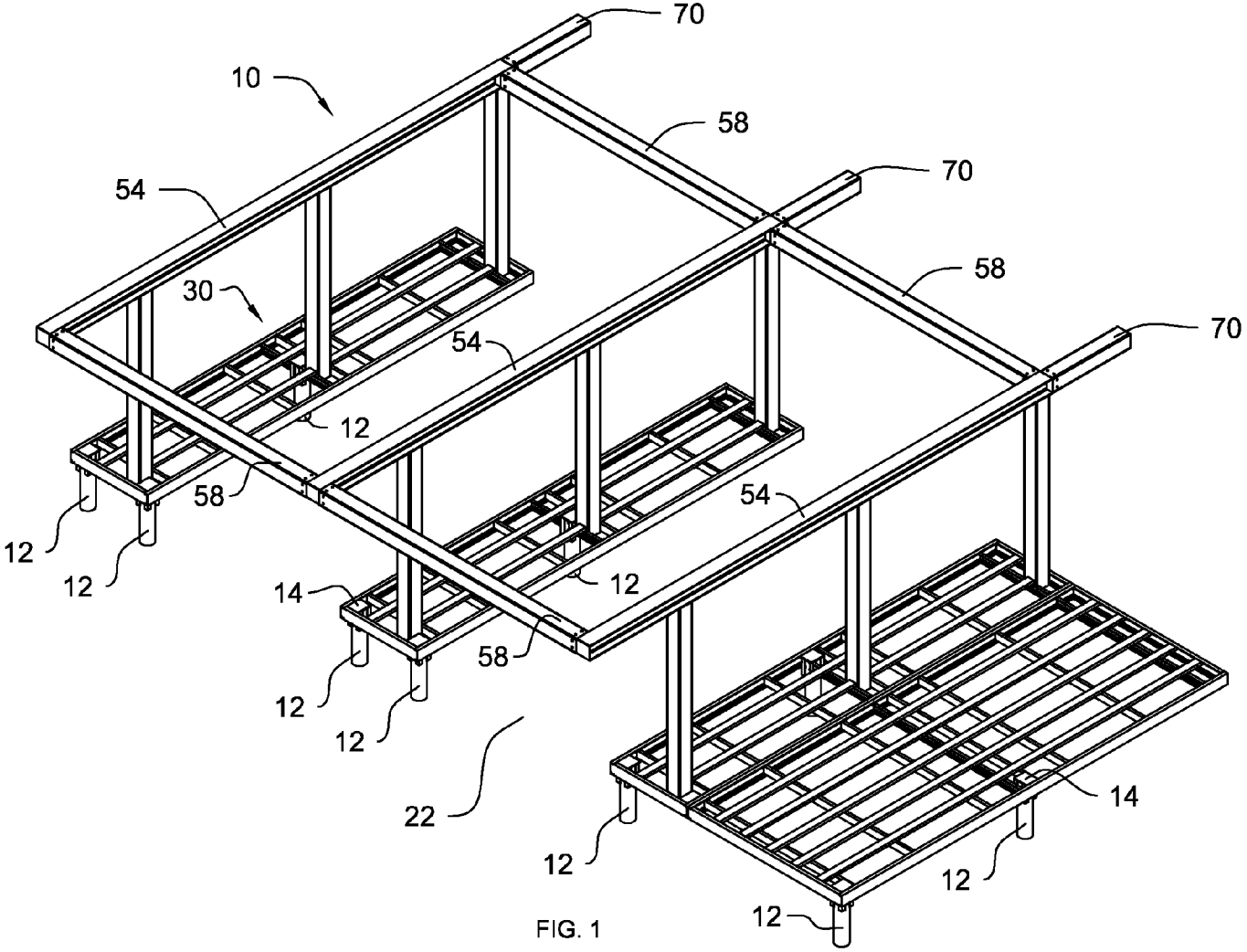
FIG. 1 is a perspective view of the modular dock structure.

In the following description, to the extent possible for clear description, elements that appear in different figures will bear the same reference numerals.

FIG. 1 is a perspective view of the modular dock structure.

A modular dock structure 10 is comprised of one or more dock structure modules 20. The walkway modules 30 of a dock structure module 20 are affixed to vertical piling 12 driven into the bed of a body of water. The vertical piling 12 support the dock structure module 20. The vertical piling 12 are not a pre-fabricated part of the modular dock structure 10, but provide the foundation upon which the modular dock structure 10 is constructed. The vertical piling 12 to support the modular dock structure 10 are driven into the bed of a body of water at pre-determined locations and a dock structure module 20 is then affixed atop the vertical piling 12.

In the preferred embodiment, the vertical piling 12 are steel pipes with 7" outside diameter and ⅜" thickness and are affixed at a plurality of locations on each walkway module 30 by inserting the vertical piling through the lower surface 33 of the walkway module 30 and affixing by mechanical affixing means. In the preferred embodiment, the vertical piling 12 is capped with a piling end cap 14 which is inserted into the walkway module 30 to provide a rigid structure. The vertical piling 12 and piling end cap 14 are not powder coated. The piling end cap 14 is welded to the vertical piling 12 and the walkway module 30. In the preferred embodiment, the piling end cap 14 is welded at an appropriate location to support each walkway module 30. The landward side of a modular dock structure may be affixed to vertical piling 12 or may be affixed to a shore wall or other structure sufficient to support the modular dock structure 10. Such vertical piling 12, shore walls or other foundation for the modular dock structure 10 are permanently affixed to the landward side of the walkway module 30 by mechanical affixing means which can be welding. A series of dock structure modules 20 can be stacked adjacent to each other laterally and can be connected to create multiple bays for the stationing of multiple watercraft. Each bay may employ a boat hoist 160 which can be employed to remove a watercraft stationed in the associated bay from the body of water for cleaning, access to the hull and for storage. In the preferred embodiment, a boat hoist 160 is constructed to be slidably retained by opposing upper side members 54 with engagement of the boat hoist being accomplished by the upper and lower flange surfaces of the I-beam 57 and 59 of the opposing upper side members 54. In an alternative embodiment where a boat hoist 160 would be employed within a given dock structure module 20, a pair of angle iron tracks 170 creating a retaining channel for the boat hoist 160 are permanently affixed to the opposing upper side members 54 of an associated dock structure module 20. A modular dock structure 10 can be built in a variety of configurations depending upon the orientation of the dock structure modules 20 and the number of dock structure modules 20 desirable to be used.

Figure 2:
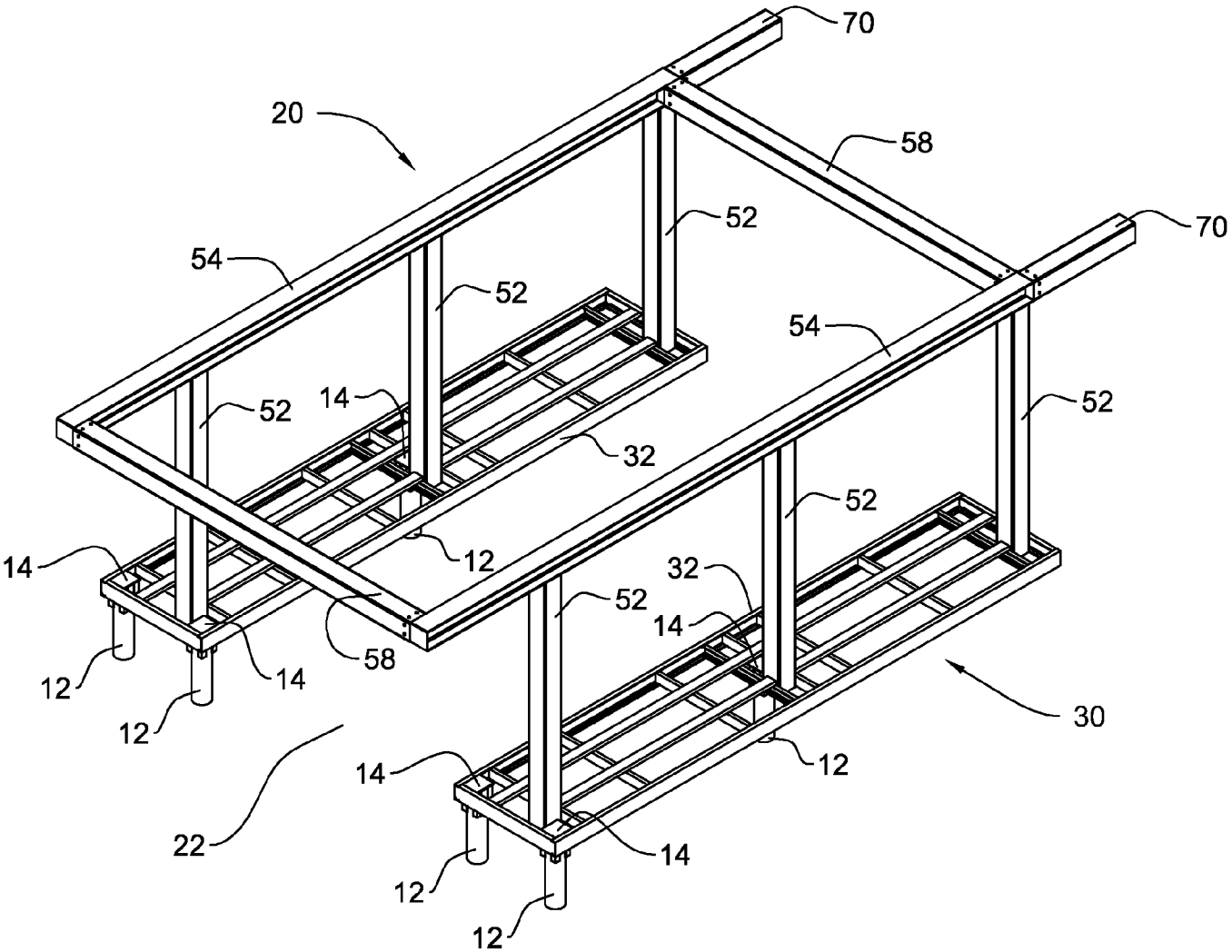
FIG. 2 is a perspective view of a dock structure module and illustrates configuration in its simplest form.

FIG. 2 is a perspective view of a dock structure module and illustrates configuration in its simplest form.

A dock structure module 20 is comprised of a pair of horizontal opposing walkway modules 30 which each support a pair of opposing vertical side modules 50 which are joined by a pair of transverse upper cross members 58. The dock structure module 20 defines a bay or a empty space 22 between the opposing walkway modules 30 which are spaced sufficiently to define a bay or empty space 22 to enable a watercraft of the appropriate size to travel linearly between the innermost face member 32 of each walkway module 30 without the watercraft contacting the innermost face of the face member 32. In the preferred embodiment, the distance between the innermost face member 32 of each walkway module 30 is 120", but there may be other embodiments of smaller or larger dimension to accommodate varying sizes of watercraft.

The opposing vertical side modules 50 are comprised of a plurality of vertical support members 52 which elevate upper side members 54 perpendicular to the walkway module 30. The upper side members 54 receive a pair of couplers at each end. Such end couplers are received by an upper cross member 58 which is connected to and received at both ends by the opposing couplers at the same end of opposing upper side members 54, defining a rectangular frame upon which a roof can be supported.

The preferred embodiment uses a steel I-beam for the upper side members 54 and steel square tubing for the vertical support members 52 and upper cross members 58. The ends of upper cross members 58 and upper side members 54 may be joined with single front tube couplers 90 on the waterward side of a body of water and single rear tube couplers 80 on the landward side of a body of water when the modular dock structure 10 consists of one dock structure module 20. When a modular dock structure 10 consists of more than one dock structure module 20, a double front tube coupler 100 is used to join upper side members 54 and upper cross members 58 on the waterward side where an interior vertical side module 50 is used. Likewise, in such applications where a plurality of dock structure modules 20 are used, a double rear tube connector 110 is used on the landward side of the body of water to connect upper side members 54 to upper cross members 58 above an interior walkway module 30.

In the preferred embodiment, all walkway modules 30 is powder coated, each upper side member 54 is powder coated, each vertical support member 52 is powder coated, each upper cross member 58 is powder coated, and all single rear tube couplers 80, all single front tube couplers 90, all double rear tube couplers 110, and all double front tube couplers 100 are powder coated before installation and assembly of a dock structure module 20 to dramatically increase the lifespan of the dock structure module 20 and dramatically slow the deterioration due to oxidation and other deleterious processes of weather and other impact damage. In the preferred embodiment, the upper side members 54 and upper cross members 58 are elevated 96" above the top most surface of a walkway module 30, enabling all but the very largest of human beings to traverse the top of a walkway module's 30 surface without impacting its head upon the upper side members 54 or upper cross members 58. Other embodiments may vary the 96 inch height to a variety of other specific dimensions depending upon the application.

Figure 3:
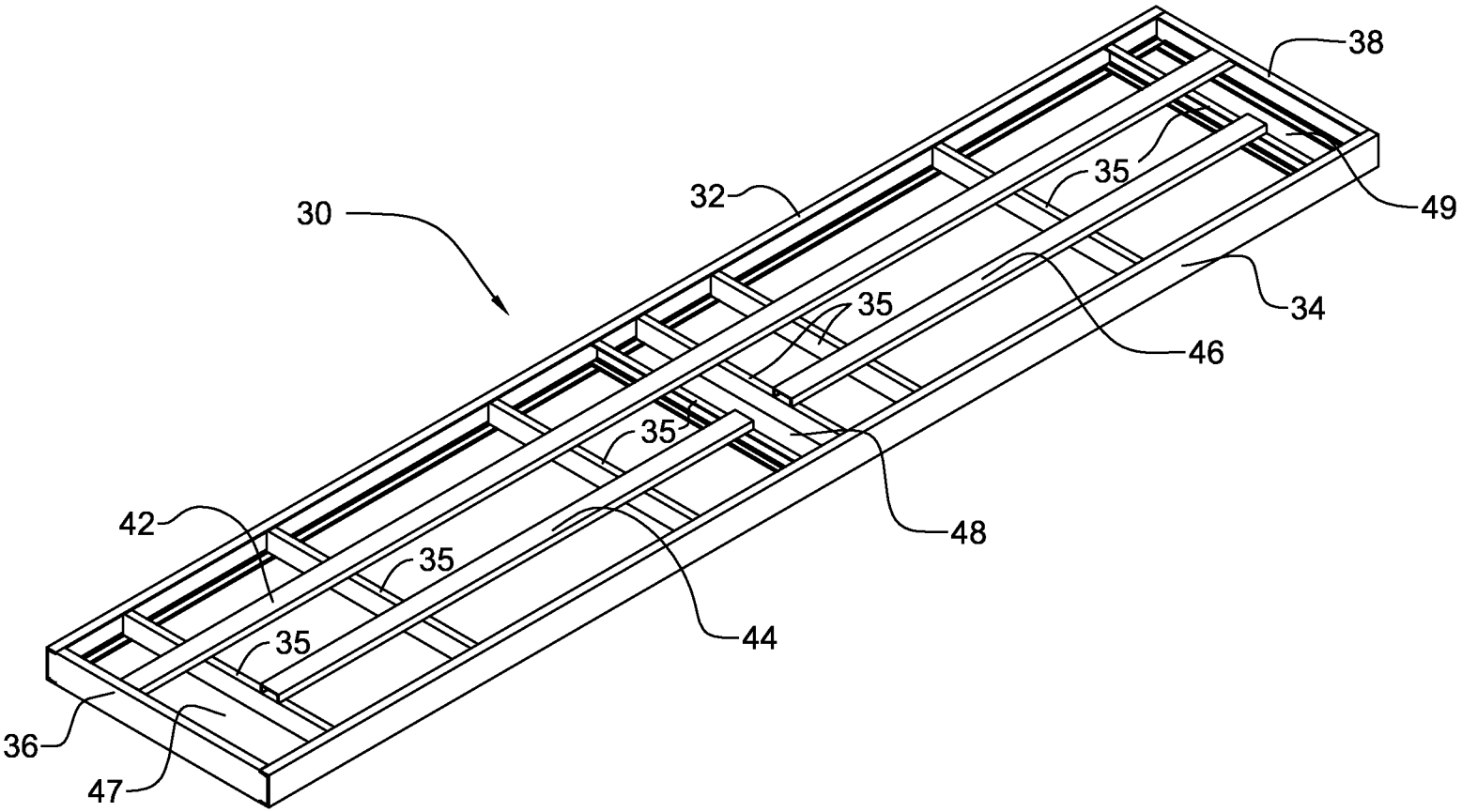
FIG. 3 is a perspective view of the walkway module shown in FIG. 2.

FIG. 3 is a perspective view of the walkway module shown in FIG. 2.

This figure illustrates the design of the walkway module 30 portion of the dock structure module 20. The walkway module 30 is comprised of a pair of opposing side members 32 and 34 and a pair of opposing end members 36 and 38. A plurality of spaced decking support members 35 are arranged perpendicular to the opposing side members 32 and 34 with the ends of the decking support members 35 affixed to the interior of the opposing side members 32 and 34. The decking support members 35 are spaced to create a plurality of receiving cavities 47, 48 and 49 into which the lower end of each vertical support member 52 is inserted and affixed such that each vertical support member 52 is supported by its associated walkway module 30.

Each decking support member 35 is recessed below the top most surface of the side members 32 and 34 and the end members 36 and 38. In the negative space created by the recession of each decking support member 35, a plurality of top support members 42, 44 and 46 lay perpendicular to and across the decking support members 35 with the lower most surface of each top support member 42, 44 and 46 affixed to each deck support member 35 it crosses at the location of the intersection. The exterior most top support members 42, 44 and 46 are placed in such a way that they do not cover the receiving cavities 47, 48 and 49 created by adjacent decking support members 35.

The side members 32 and 34 and the end members 36 and 38 and the decking support members 35 and the top support members 42, 44 and 46 all have top most surfaces which support decking. In the preferred embodiment there are eight decking support members 35 and four of those decking support members 35 are evenly spaced between the end members 36 and 38, while another decking support member 35 is placed immediately adjacent to each end member 36 and 38 to create a receiving cavities 47 and 49 sufficient to receive the lower most end of a vertical support member 52, with the remaining decking support members 35 placed on either side of the mid-point of each side member 32 and 34 to likewise define a receiving cavity 48 for the lower most end of a vertical support member 52. In the preferred embodiment, the area of the top surface of a walkway module 30 is eighty square feet defined by side members 32 and 34 that are 240" long and end members 36 and 38 that are 48" wide. In the preferred embodiment, the vertical support members 52 are made from steel square tubing of 6"×6" or 8"×8" and are positioned 14" to the left of the right most edge of the right most side member 32 for steel square tubing of 6"×6" and 13" to the left of the right most edge of the right most side member 32 for steel square tubing of 8"×8" when viewed from the waterward side of the dock structure module 20.

Figure 4:
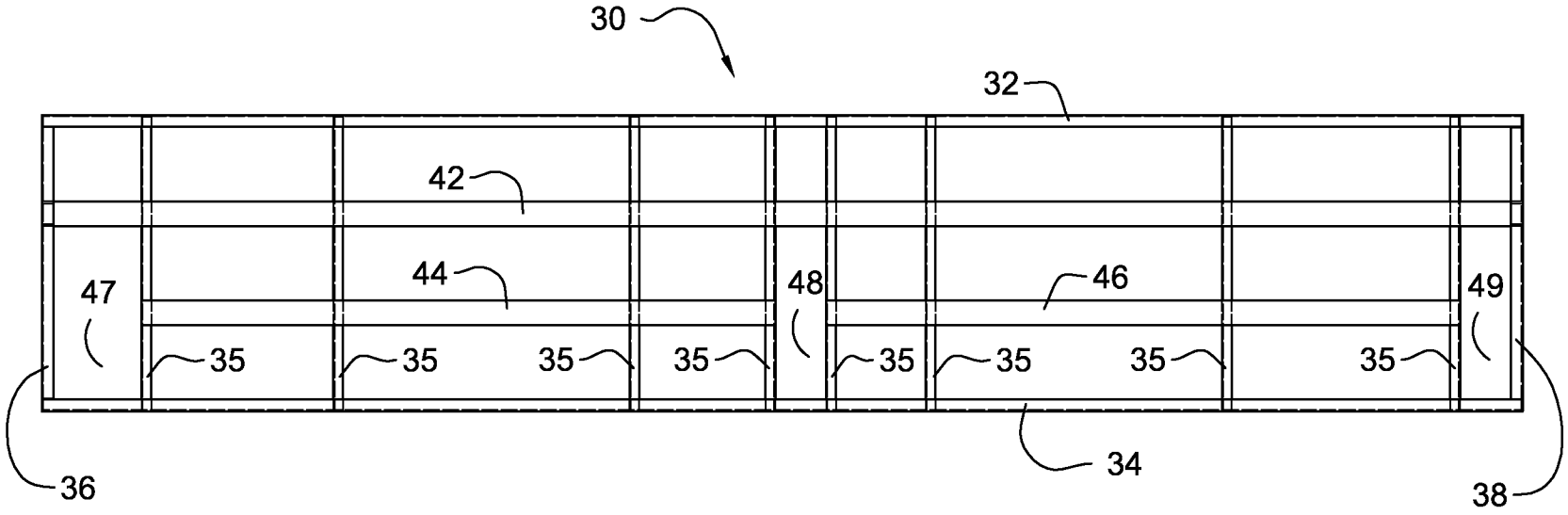
FIG. 4 is a top view of a walkway module shown in FIG. 3.

FIG. 4 is a top view of a walkway module shown in FIG. 3.

This view illustrates the configuration of the side members 32 and 34, end members 36 and 38, decking support members 35 and top support members 42, 44 and 46 as viewed from the top, showing the defined receiving cavities 47, 48 and 49 in which the lower most ends of the vertical support members 52 are received.

Figure 5:
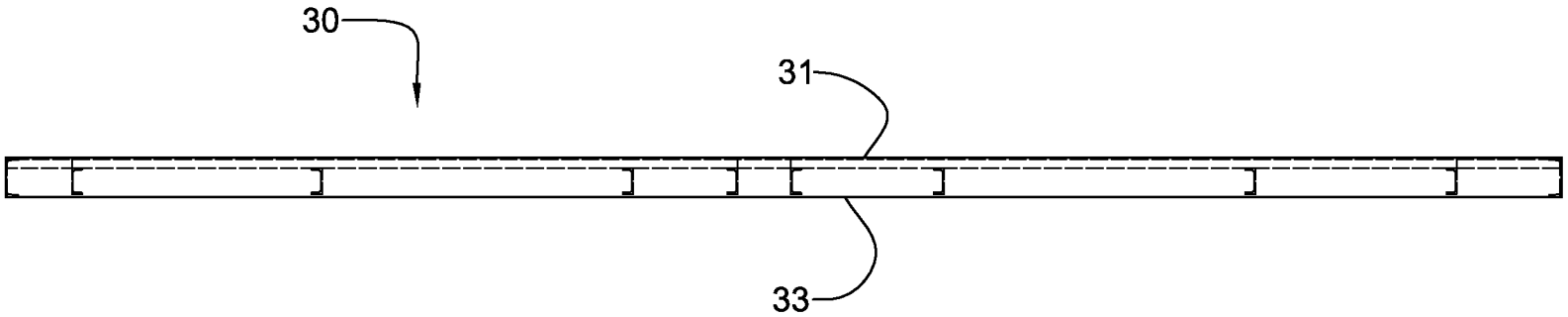
FIG. 5 is a face view of a walkway module shown in FIG. 3.

FIG. 5 is a face view of a walkway module shown in FIG. 3.

A walkway module 30 has an upper surface 31 and a lower surface 33. The upper surface 31 is comprised of side members 32 and 34 and end members 36 and 38, decking support members 35 and top support members 42, 44 and 46 which provide support and strength for placing decking on the upper surface 31 of a walkway module 30. Decking can be acquired in a variety of formats, including pre-fabricated concrete, wood products, tile products, and other suitable substances upon which human beings can traverse a walkway module 30. Such decking is affixed to the walkway module 30 by affixing means to form a continuous surface on the upper surface 31 of the walkway module 30. In the preferred embodiment, the walkway module 30 is powder coated before it is joined or affixed to vertical support members 52. After powder coating, vertical support members 52 can be joined with an associated walkway module 30 during installation and assembly. A walkway module 30 can be joined or affixed to vertical support members 52 after the walkway module 30 and vertical support members 52 have been powder coated. In that circumstance, the powder coating at the location of the weld will be disrupted. However, the location of the weld will be beneath the surface of the decking placed on the upper surface 31 of the walkway module 30 so that any such weldment will be concealed from view and not disrupt the visible portion of the powder coating.

Figure 6:
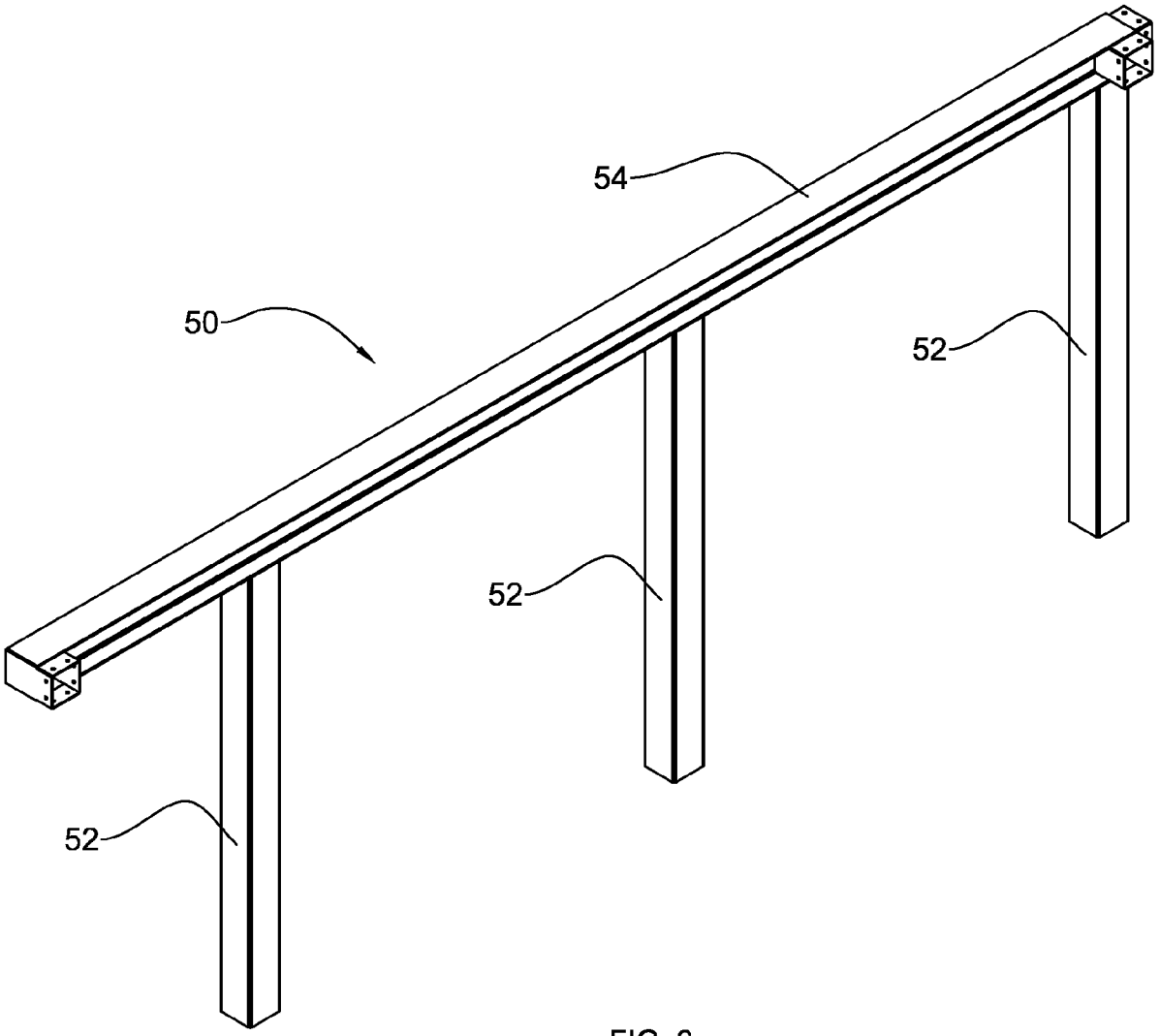
FIG. 6 is a perspective view of a vertical side module shown in FIG. 2.

FIG. 6 is a perspective view of a vertical side module shown in FIG. 2.

The vertical side module 50 is comprised of an upper side member 54 and a plurality of vertical support members 52 which are affixed at their upper most end and spaced apart along the underside of the upper side members 54. The upper side members 54 have receiving cavities 53 and 55 at each end for a coupler to enable the upper side member 54 to be fixed and connected to upper cross members 58. A variety of couplers can be used to affix and connect an upper side member 54 to an upper cross member 58 depending upon whether there will be one dock structure module 20 in the ultimate modular dock structure 10 or a plurality of dock structure modules 20 in the modular dock structure 10. In the preferred embodiment, the upper side member 54 is a steel I-beam 288" in length with the flange surfaces of the I-beam 57 and 59 oriented so they are horizontal. The lower flange of the I-beam 59 is affixed to the uppermost end of each vertical support member 52. There are three vertical support members 52 in the preferred embodiment and in the preferred embodiment the vertical support members 52 are made from steel square tubing, 6"×6" or 8"×8" dimension, with the waterward most face of the vertical support member 52 located 50" from the waterward most end of the upper side member 54, the interior vertical support member 52 located 109" from the landward face of the waterward most vertical support member 52 and the waterward face of the most landward vertical support member 52 located 109" landward of the landward face of the interior vertical support member 52.

The lower most end of the vertical support members 52 are received by the receiving cavities 47, 48 and 49 of a walkway module 30 and are affixed between adjacent, associated decking support members 35. In the preferred embodiment, the uppermost end of the vertical support members 52 are affixed to the upper side members 54 by welding the vertical support members 52 to the upper side members 54. These welds are made prior to powder coating. After the vertical support members 52 have been welded to the upper side members 54, the couplers that will be used to attach upper cross members 58 are welded to the upper side members 54 and then the vertical side module 50 is powder coated.

In the preferred embodiment, there is a dock structure module 20 defined by a pair of walkway modules 30 that each have an associated vertical side module 50 extending above them. Each vertical side module 50 is connected to the other by use of an upper cross member 58 at each end of the vertical side module 50 to define a rectangular structure which is supported above the opposing walkway modules 30. In the preferred embodiment, a roof structure which can be of varied design, is placed upon the elevated rectangular area defined by the upper side members 54 and upper cross members 58 in order to protect persons on the walkway module 30 and items on the walkway module 30 from exposure to the elements, falling rain, avian species in flight overhead, the harmful rays of the sun, etc.

Figure 7:
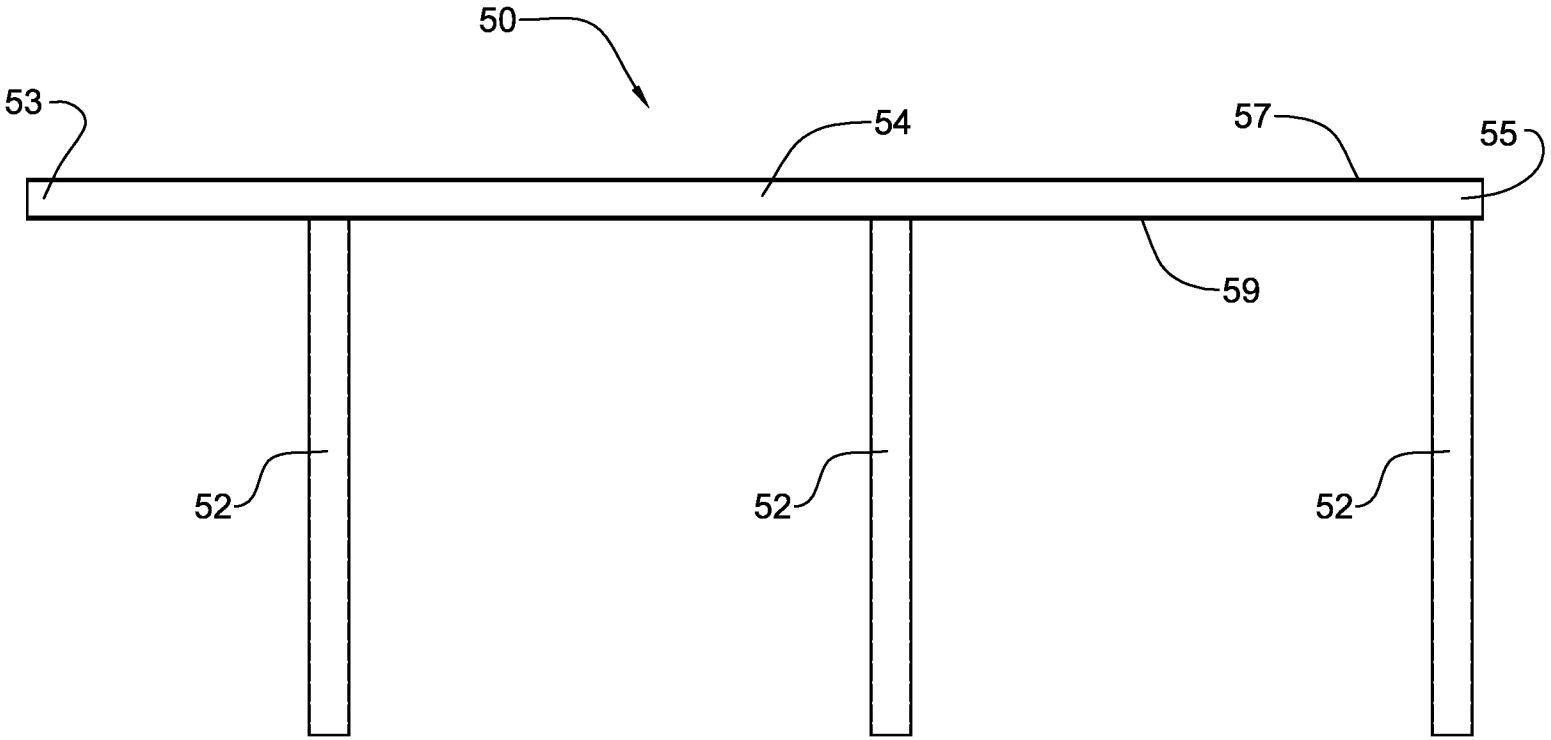
FIG. 7 is a side view of the vertical side module shown in FIG. 6.

FIG. 7 is a side view of the vertical side module shown in FIG. 6.

This figure shows the orientation of vertical support members 52 and their associated upper side members 54 as well as the receiving cavities 53 and 55 on each end of the upper side member 54.

Figure 8:
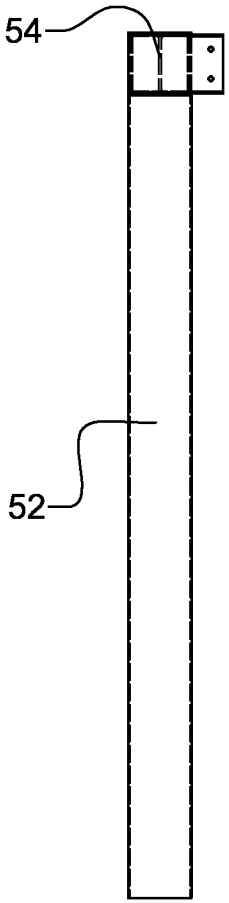
FIG. 8 is an end view of the vertical side module shown in FIG. 6.

FIG. 8 is an end view of the vertical side module shown in FIG. 6.

This figure illustrates the receiving cavity 53 on the waterward side of a vertical side module 50. The waterward receiving cavity receives and accepts the insertion of a single front tube coupler 90 or a double front tube coupler 100 to enable the waterward side of an upper side member 54 to be connected to an associated upper cross member 58. The single front tube coupler 90 is used in applications where the vertical side module 50 forms the outermost edge of the frame of a dock structure module 20, while a double front tube coupler 100 is used to join an interior upper side member 54 to two associated upper cross members 58 for applications for which there is more than one dock structure module 20 in a given modular dock structure 10.

While the use of weldments to join metallic and steel members or elements is a useful process, in general, it is destructive to the powder coating applied to the elements or members of the dock structure module 20 and thus undesirable as a means for joining the elements or members of the completed assembly. To avoid and limit the use of weldments in the completed assembly four novel couplers have been designed to couple the elements and members of the dock structure module 20 to each other. Said couplers are discussed and described in more detail below. In the preferred embodiment, all of said couplers are either welded to their associated members or elements and then powder coated after the weldments are made or are coupled to their associated members or elements by the use of standard fasteners which do not damage the powder coating applied to the couplers at the time of assembly.

Figure 9:
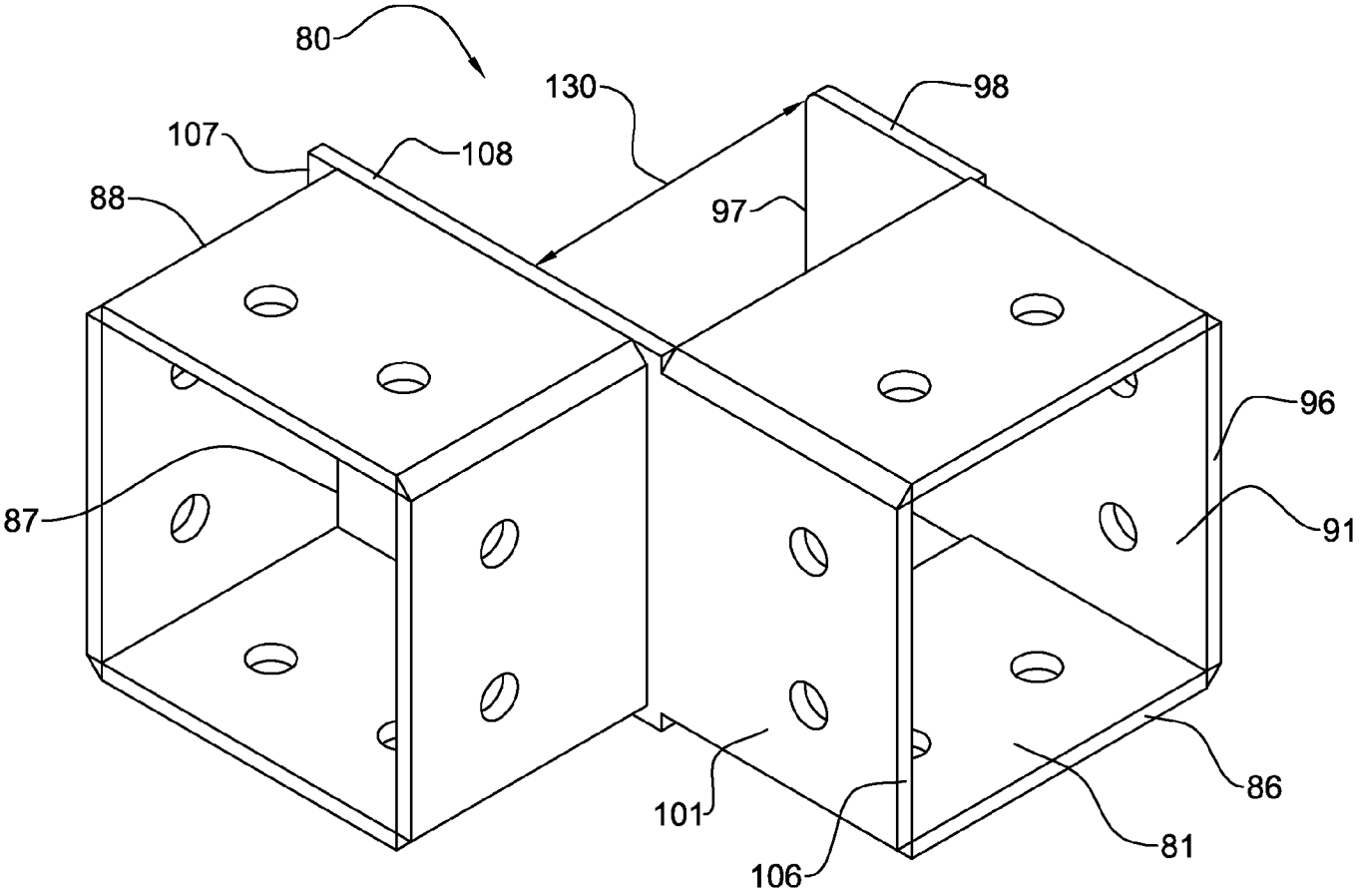
FIG. 9 is a perspective view of a single rear tube coupler that may be used with the dock structure module shown in FIG. 2.

FIG. 9 is a perspective view of a single rear tube coupler that may be used with the dock structure module shown in FIG. 2.

The single rear tube coupler 80 joins an upper side member 54 to an associated upper cross member 58 on the landward side of a dock structure module 20. The single rear tube coupler 80 enables two adjacent vertical side modules 50 to be joined by an upper cross member 58. A single rear tube coupler 80 is comprised of six connector plates 81, one inner connector plate 91, and one single end connector plate 101. Each connector plate 81 has a leading edge 86, a trailing edge 87, and a pair of opposing side edges 88. Each inner connector plate 91 has a leading edge 96, a trailing edge 97 and opposing perpendicular side edges 98. Each single end connector plate 101 has a leading edge 106, a trailing edge 107 and opposing perpendicular side edges 108. The single rear tube coupler 80 is constructed by welding the side edge 88 of a connector plate 81 to the side edge 88 of a second connector plate 81, longitudinally, so that the leading edges 86 form a right angle and so that said leading edges 86 are planar with one another. A third connector plate 81 is then welded longitudinally along its side edge 88 to the side edge 88 of a connector plate 81 at the side edge 88 opposite where the weld between the first two connector plates 81 was made so its leading edge 86 forms a right angle with the connector plate 81 to which it is welded and is planar with the leading edges 86 of the other two welded connector plates 81 such that its unwelded side edge 88 is planar with the unwelded side edge 88 of the first connector plate 81. A fourth connector plate 81 is then welded on each side edge 88 to the receiving unwelded side edges 88 of the other two connector plates 81 so that it forms a right angle with both connector plates 81, forming a square male insertion adapter 120.

The single rear tube coupler 80 is comprised of a male insertion adapter 120 that can be inserted into and received by the receiving cavity of the upper cross member 58, a male insertion adapter 120 that can be inserted into and received by the receiving cavity of an upper side member 54, and a female receiving adapter 130 which can receive the receiving cavity of an upper side member 54 that is longitudinally centric and planar with an associated upper side member 54 and having both male insertion adapters 120 longitudinal with the female receiving adapter 130 and both male insertion adapters 120 simultaneously perpendicular to each other and with each male insertion adapter 120 having means of mechanically connecting it to an upper cross member 58 through the use of standard style fasteners, such as nuts and bolts, that hold each male insertion adapter 120 inside the receiving cavity of an upper cross member 58 by means of a nut and bolt or other similar fastener which engages the receiving cavity of the upper side member 54 or upper cross member 58 and male insertion adapter 120 simultaneously so as to prevent disengagement by traction, and simultaneously having means of engaging the female receiving adapter 130 by use of a weldment or other mechanical means.

In the preferred embodiment, the female receiving adapter 130 is welded to an upper side member 54 which is a steel I-beam.

Figure 13:
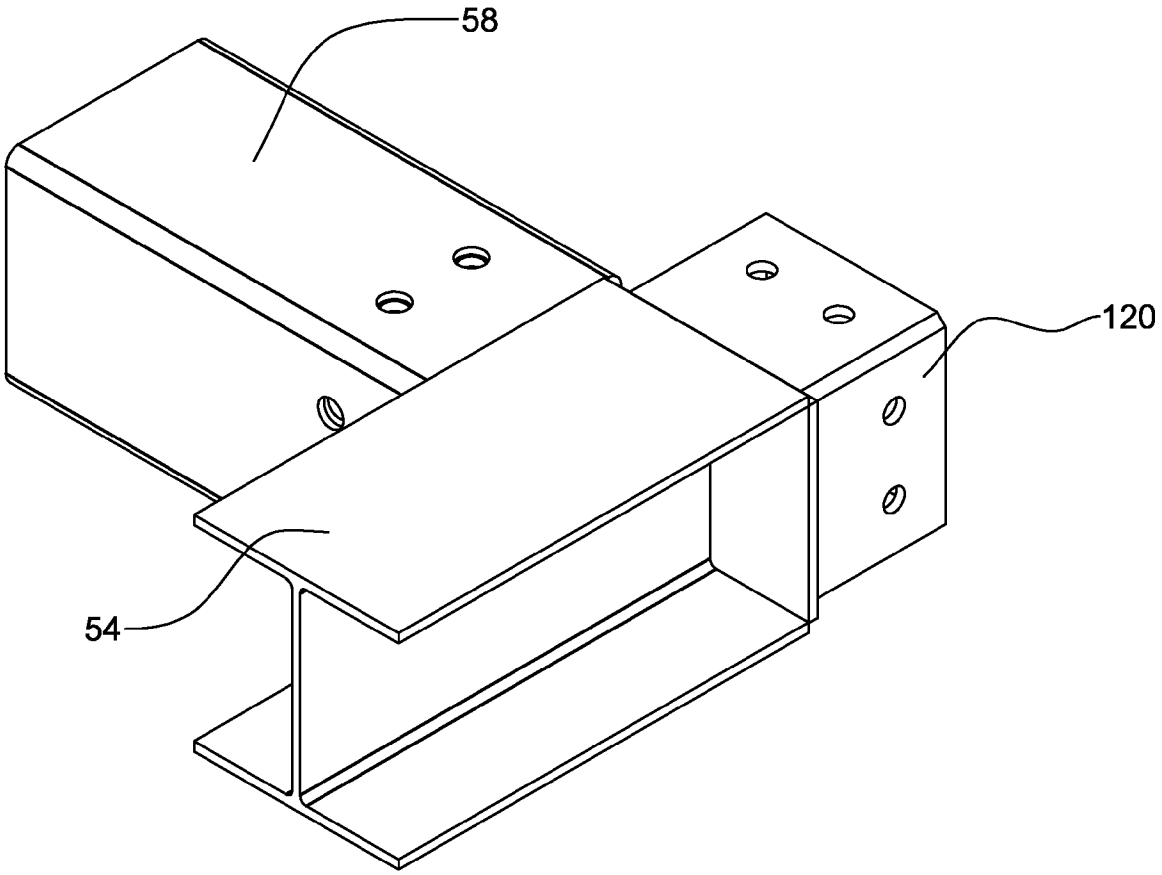
FIG. 13 is a perspective view of a single rear tube coupler shown in FIG. 9 coupled with an upper cross member and upper side member as shown in FIG. 2.

The single rear tube coupler permits, in the preferred embodiment, the upper cross member 58 and upper side member 54 of the dock structure module 20 to be joined as depicted in FIG. 13 as described and illustrated below.

Figure 10:
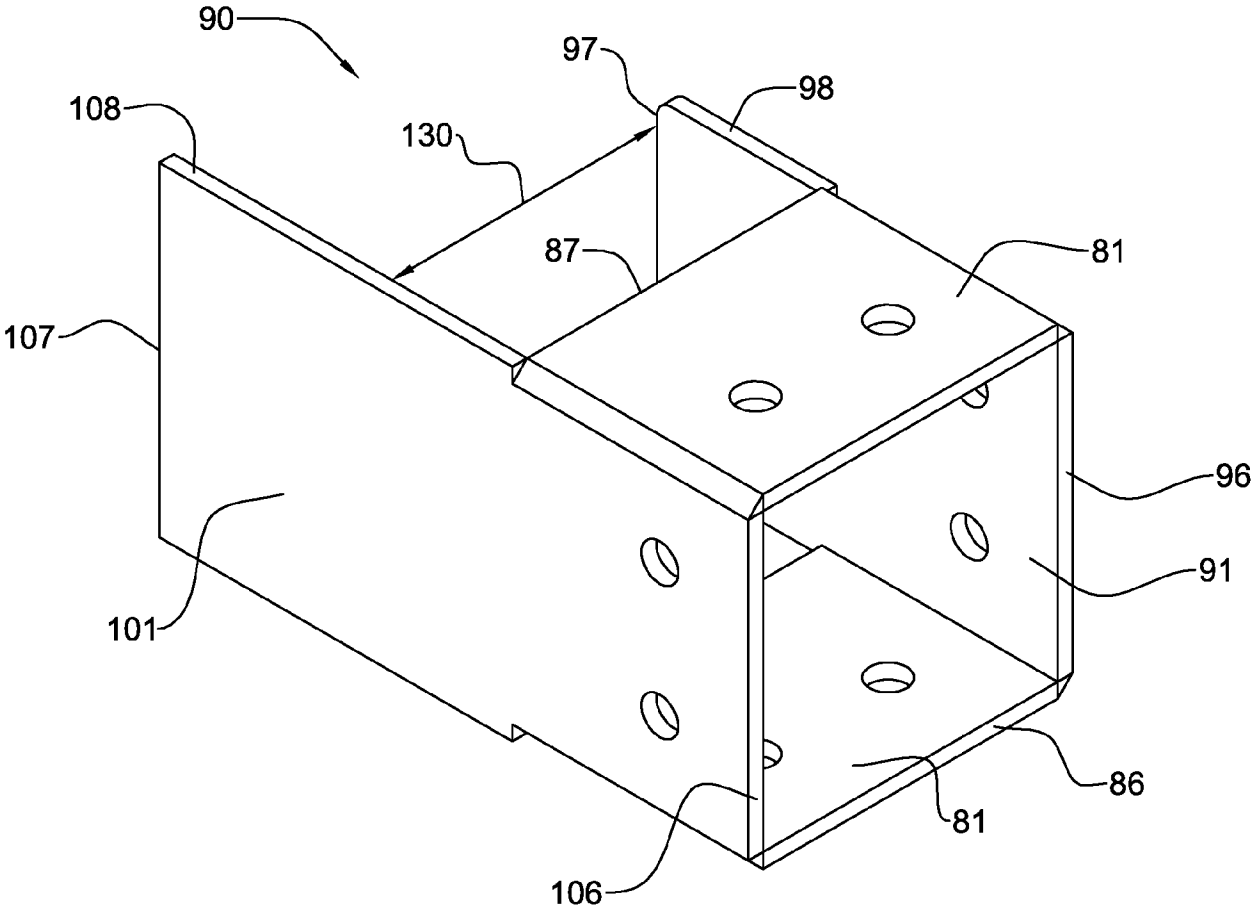
FIG. 10 is a perspective view of a single front tube coupler hat may be used with the dock structure module shown in FIG. 2.

FIG. 10 is a perspective view of a single front tube coupler that may be used with the dock structure module shown in FIG. 2.

A single front tube coupler 90 is comprised of a male insertion adapter 120 and a female receiving adapter 130 wherein the male insertion adapter 120 and female receiving adapter 130 are longitudinally aligned and planar with each other. The male insertion adapter 120 is designed to be inserted into the end of an upper cross member 58 and to be received by the receiving cavity of an upper cross member 58 and the female receiving adapter 130 is designed to be affixed to an upper side member 54 by mechanical affixing means, which is affixed by welding in the preferred embodiment.

In the preferred embodiment, the single front tube coupler 90 is made of steel and is comprised of two connector plates 81, an inner connector plate 91 and a single end connector plate 101. The single front tube coupler is constructed by welding the side edge 88 of a connector plate 81 to the side edge 98 of an inner connector plate 91, longitudinally, so that the leading edges 86 and 96 form a right angle and so that said leading edges 86 and 96 are planar with one another. A second connector plate 81 is then welded longitudinally along its side edge 88 to the unwelded side edge 98 of the inner connector plate 91 at the side edge opposite where the weld between the connector plate 81 and inner connector plate 91 was made so that its leading edge 86 forms a right angle with the inner connector plate 91 to which it is welded and is planar with the leading edges 86 and 96 of the previously welded connector plate 81 and inner connector plate 91 and such that is unwelded side edge 88 is planar with the unwelded side edge 88 of the first connector plate 81. A single end connector plate 101 is then welded on each side edge 108 to the remaining unwelded side edges 88 of the two connector plates 81 so it forms a right angle with both connector plates 81, forming a square male insertion adapter 120.

The single front tube coupler 90 is used to join the upper cross member 58 and upper side member 54 of the dock structure module 20 at a right angle on the waterward side of the dock structure module 20 for applications in which there is only one upper cross member 58 being connected to the associated upper side member 54 which will always be the case in the construction of a modular dock structure 10 containing only one dock structure module 20. The single front tube coupler 90 is always used on the waterward end of an upper side member 54 which forms the side most edge of the dock structure module 20 of which there will always be at least two.

Figure 14:
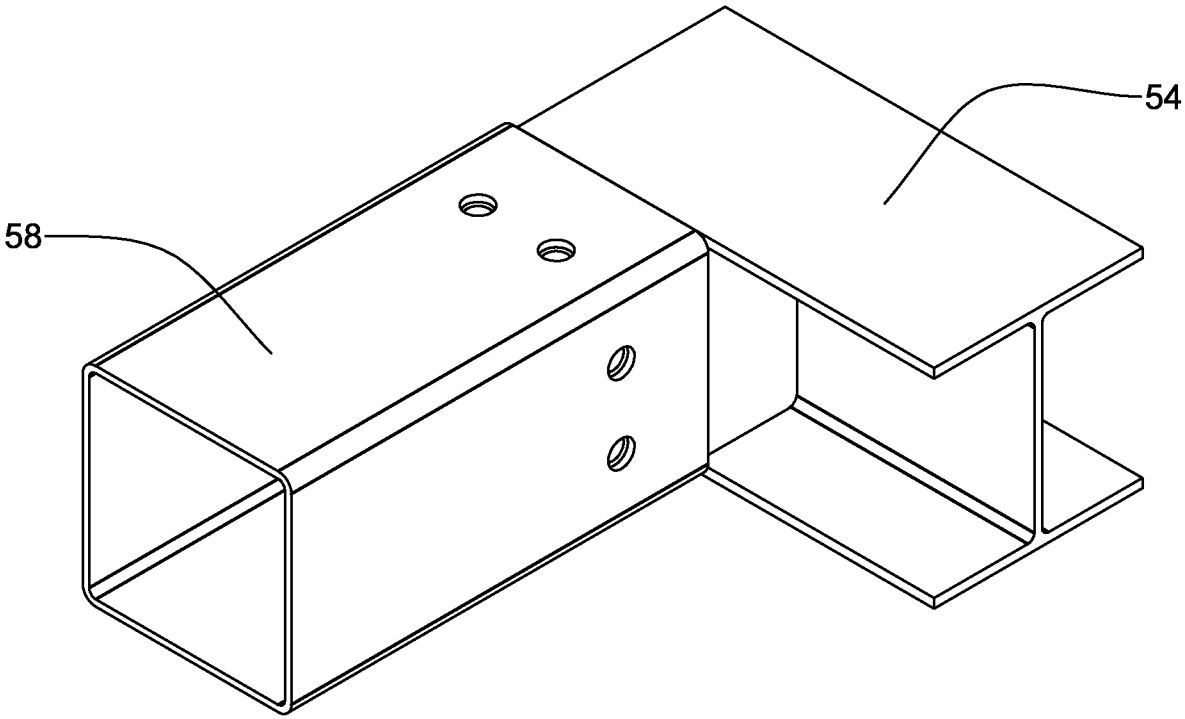
FIG. 14 is a perspective view of a single front tube coupler shown in FIG. 10 coupled with an upper cross member and upper side member as shown in FIG. 2.

The single front tube coupler 90 permits, in the preferred embodiment, the upper cross member 58 and upper side member 54 of the dock structure module 20 to be joined as depicted in FIG. 14 as described and illustrated below.

Figure 11:
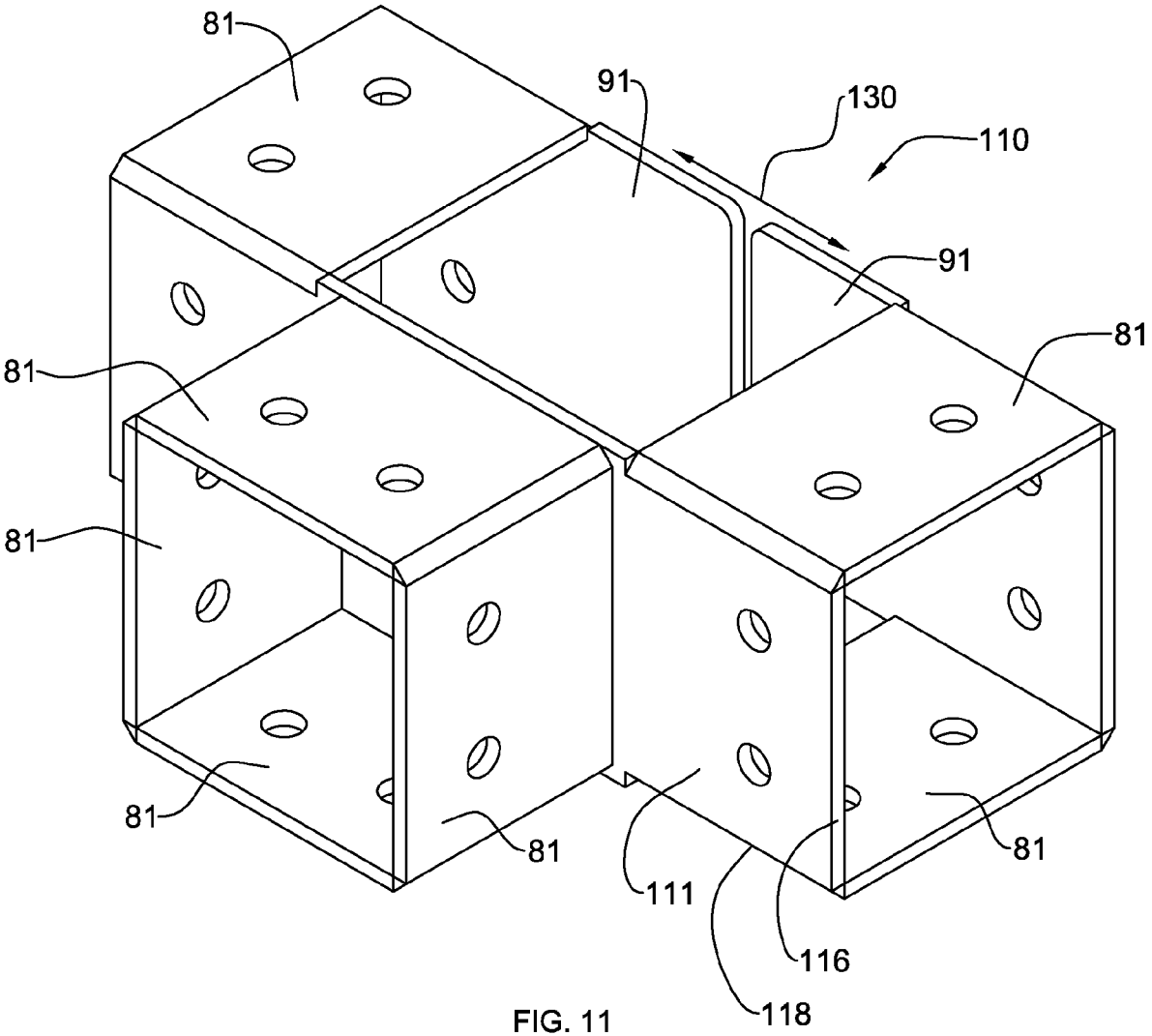
FIG. 11 is a perspective view of a double rear tube coupler that may be used with the dock structure module shown in FIG. 2.

FIG. 11 is a perspective view of a double rear tube coupler that may be used with the dock structure module shown in FIG. 2.

The double rear tube coupler 110 joins the receiving end of an upper side member 54 to the receiving end of an associated upper cross member 58 on the landward side of a dock structure module 20. The double rear tube coupler 110 enables an interior vertical side module 50 adjacent to two other vertical side modules 50 on each side of said interior vertical side module 50 to be joined by an upper cross member 58 on each side of the interior vertical side module 50 in an application where more than one dock structure module 20 is used in creating a modular dock structure 10.

A double rear tube coupler 110 is comprised of three male insertion adapters 120, having two of the adapters oriented opposing one another on a longitudinal axis and one male insertion adapter 120 centrally located and perpendicular to the longitudinal axis upon which the other two male insertion adapters 120 are aligned. The double rear tube coupler 110 is designed and used for joining the ends of two opposing upper cross members 58 to the landward receiving cavity of an upper side member 54 in applications where an interior vertical side module 50 is used in order to create a modular dock structure 10 that has more than one dock structure module 20.

In the preferred embodiment, the female receiving adapter 130 is welded to an upper side member 54 which is a steel I-beam.

Figure 15:
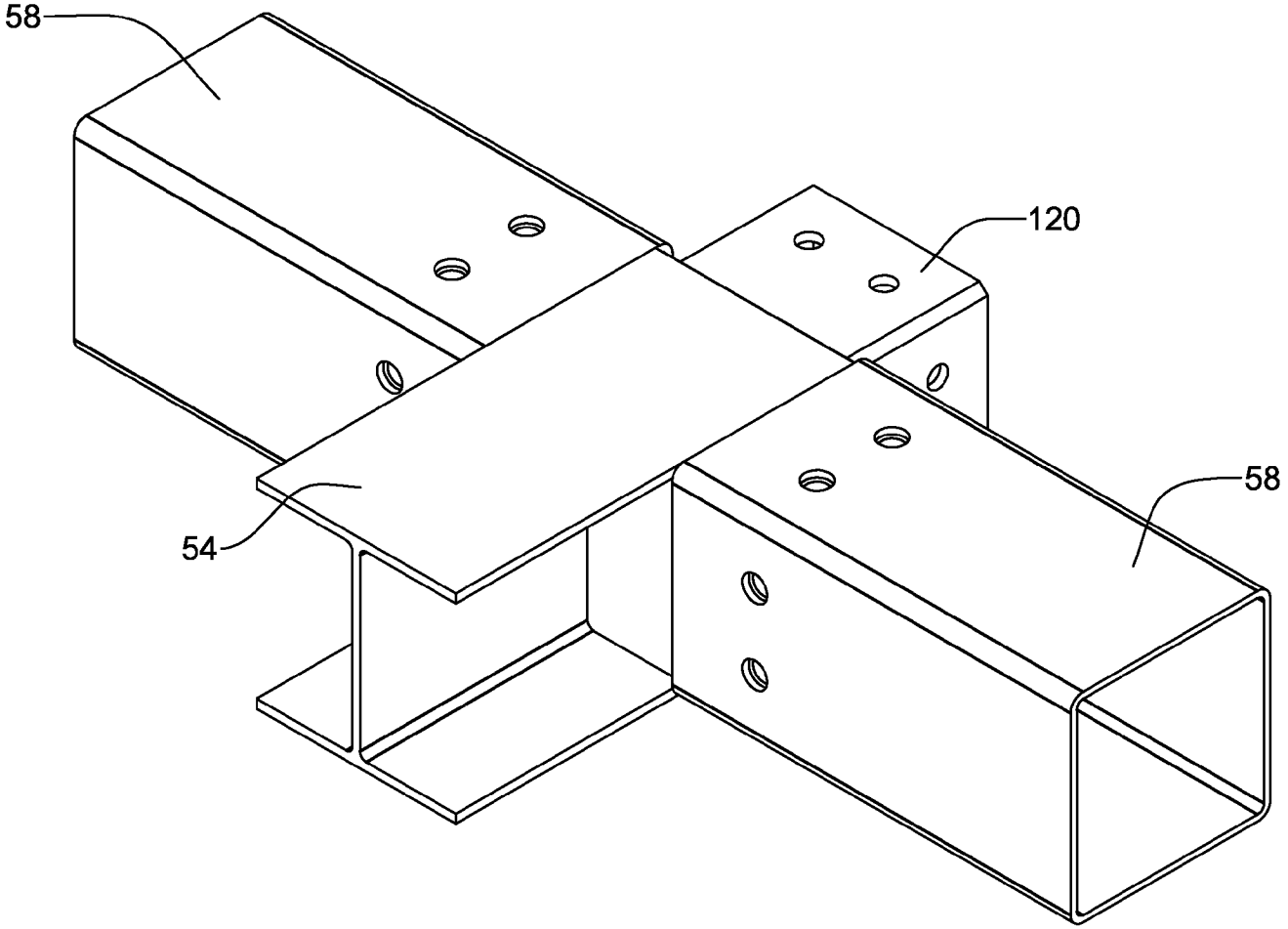
FIG. 15 is a perspective view of a double rear tube coupler shown in FIG. 11 coupled with adjacent upper cross members and upper side member as shown in FIG. 2.

The double rear tube coupler 110 permits, in the preferred embodiment the receiving ends of two upper cross members 58 and the receiving end of one upper side member 54 of the dock structure module 20 to be joined on the landward side as depicted in FIG. 15 as described and illustrated below.

In the preferred embodiment, a double rear tube coupler 110 is comprised of eight connector plates 81, two inner connector plates 91, and one double end connector plate 111, having two opposing leading edges 116 and two opposing side edges 118. The double front tube coupler 110 is constructed by welding the side edge of a connector plate 81 to the side edge 88 of a second connector plate 81, longitudinally, so that the leading edges 86 form a right angle and so that said leading edges 86 are planar with one another. A third connector plate 81 is then welded longitudinally along its side edge 88 to the side edge 88 of a connector plate 81 at the side edge 88 opposite where the weld between the first two connector plates 81 was made so that its leading edge 86 forms a right angle with the connector plate 81 to which it is welded and is planar with the leading edges 86 of the other two welded connector plates 81 such that is unwelded side edge 88 is planar with the unwelded side edge 88 of the first connector plate 81. A fourth connector plate 81 is then welded on each side edge 88 to the receiving unwelded side edges 88 of the other two connector plates 81 so that it forms a right angle with both connector plates 81, forming a square male insertion adapter 120. This square male insertion adapter 120 is then welded along the trailing edge 87 of each connector plate 81 to a double front tube coupler 100 such that the trailing edges 86 of two opposing connector plates 81 are welded longitudinally along both side edges 118 of the double front tube coupler's 100 double end connector plate 111 along the side edges 118 of the double end connector plate 111 at the location where the side edges 118 of the double end connector plate 111 are unwelded and such that the trailing edge of the connector plates 81 is affixed to the exterior surface of the double front tube coupler 100.

Figure 12:
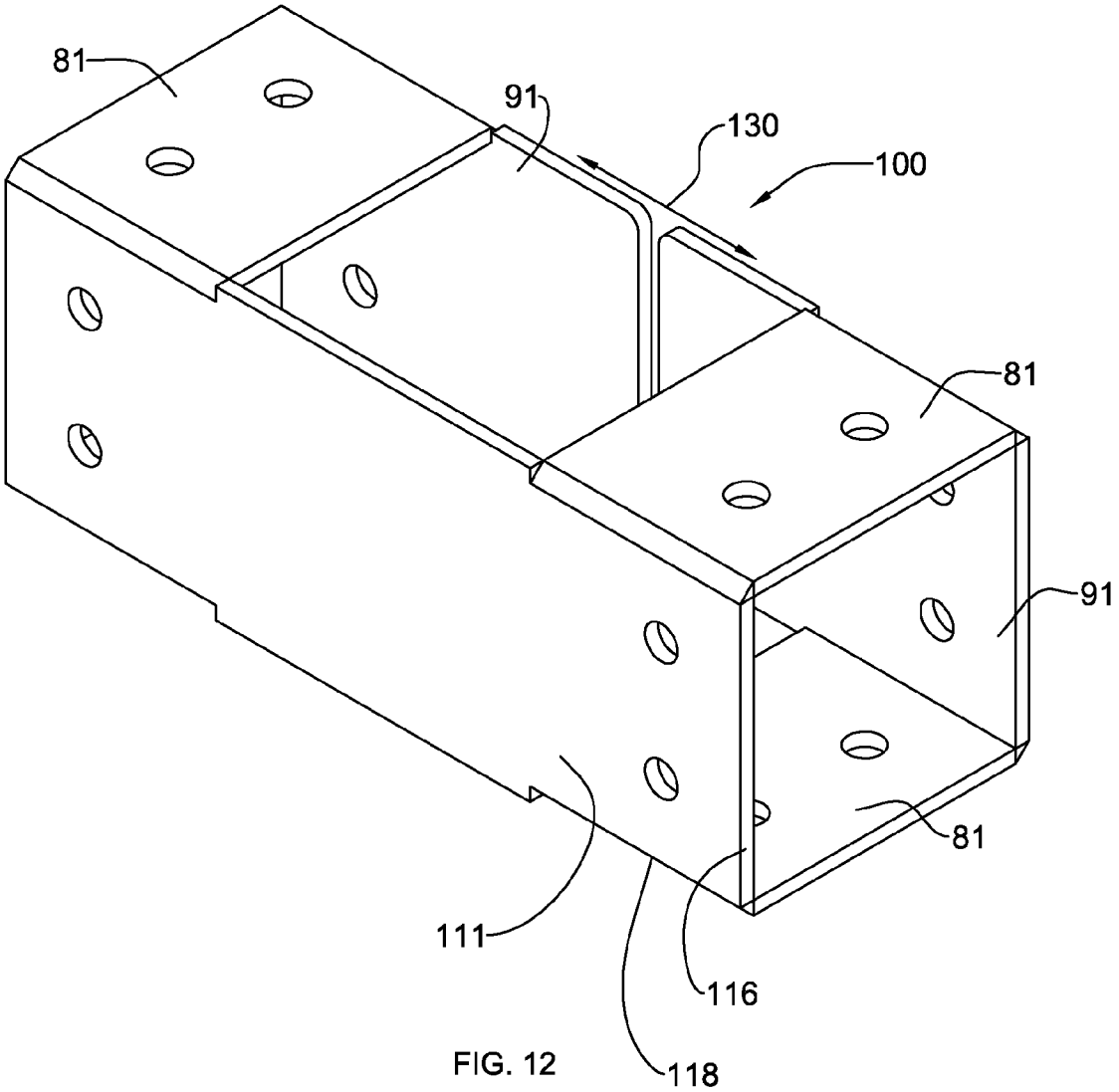
FIG. 12 is a perspective view of a double front tube coupler that may be used with the dock structure module shown in FIG. 2.

FIG. 12 is a perspective view of a double front tube coupler that may be used with the dock structure module shown in FIG. 2.

The double front tube coupler 100 joins an upper side member 54 to an associated upper cross member 58 on the waterward side of a dock structure module 20. The double front tube coupler 100 enables an interior vertical side module 50 adjacent to two other vertical side modules 50 on each side of said interior vertical side module 50 to be joined by an upper cross member 58 on each side of the interior vertical side module 50 in applications where more than one dock structure module 20 is used in creating a modular dock structure 10.

The double front tube coupler 100 is comprised of a male insertion adapter 120 that can be inserted into and received by the receiving cavity of an upper cross member 58, an opposing male insertion adapter 120 that can be inserted into and received by an upper side member 54, and a female receiving adapter 130 which can receive the receiving cavity of an upper side member 54 with the said male insertion adapters 120, opposing male insertion adapter 120, and female receiving adapter 130 longitudinally centric and planar with an associated upper side member 54 and having both male insertion adapters 120 longitudinal with the female receiving adapter 130 and both male insertion adapters 120 simultaneously longitudinally centric with each other and with each male insertion adapter 120 having means of mechanically connecting it to an upper cross member 58 through the use of standard style fasteners, such as nuts and bolts that hold each male insertion adapter 120 inside the receiving end of an upper side member 54 by means of a nut and bolt or other similar fastener which engages the receiving end of the upper cross member 58 and male insertion adapter 120 simultaneously so as to prevent disengagement by traction.

In the preferred embodiment, the female receiving adapter 130 is welded to an upper side member 54 which is a steel I-beam.

Figure 16:
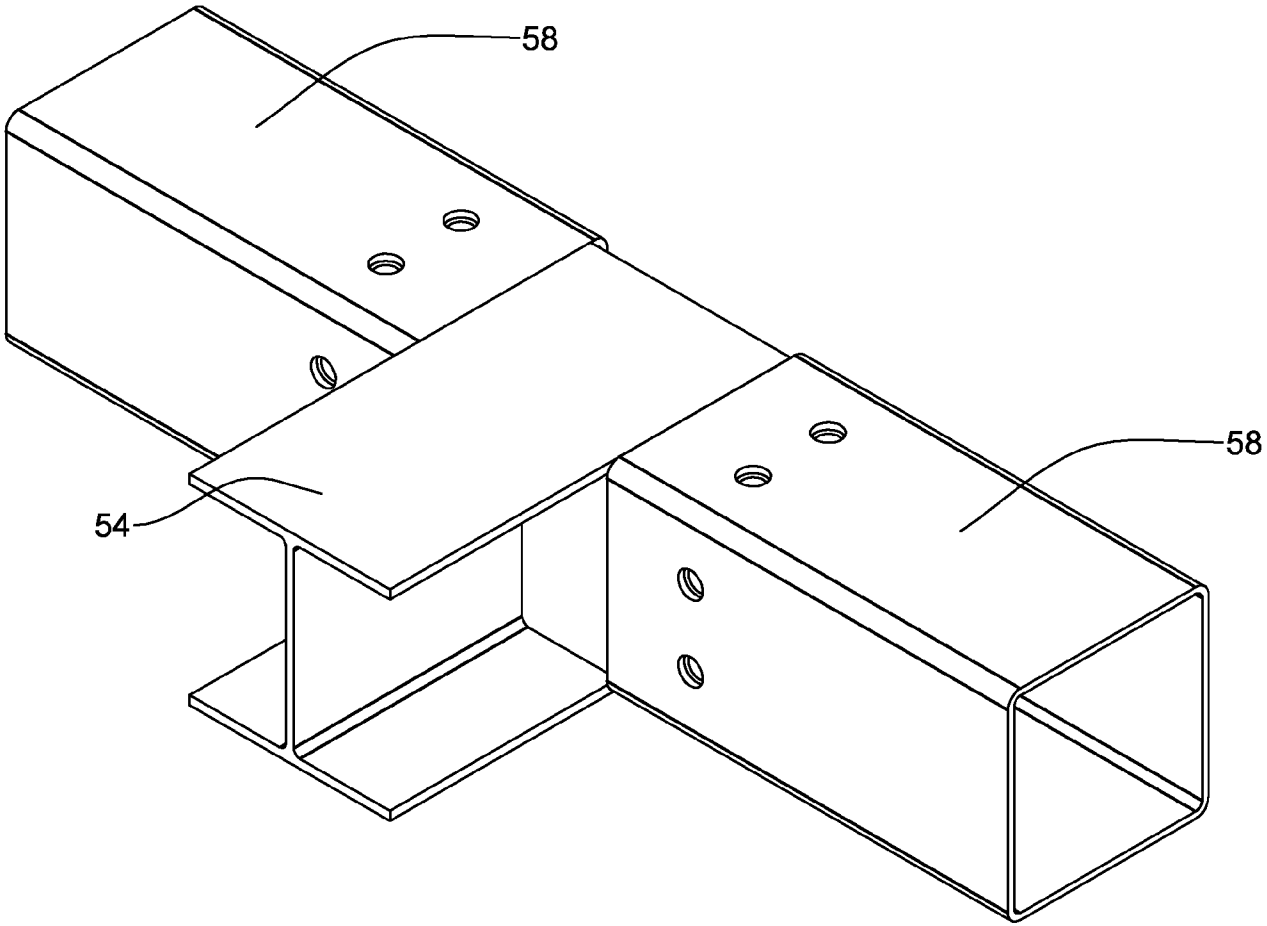
FIG. 16 is a perspective view of a double front tube coupler shown in FIG. 12 coupled with adjacent upper cross members and upper side member as shown in FIG. 2.

The double front tube coupler 100 permits, in the preferred embodiment, the receiving ends of two upper cross members 58 and the receiving end of an upper side member 54 of the dock structure module 20 to be joined as depicted in FIG. 16 as described and illustrated below.

In the preferred embodiment, a double front tube coupler 100 is comprised of four connector plates 81, two inner connector plates 91, and one double end connector plate 111. The double front tube coupler 100 is constructed by welding the side edge 88 of a connector plate 81 to the side edge 118 of a double end connector plate 111, longitudinally, so that the leading edges 86 and 116 form a right angle and so that said leading edges 86 and 116 are planar with one another. A second connector plate 81 is then welded longitudinally along its side edge 88 to the side edge 118 of the double end connector plate 111 at the side edge 118 opposite where the weld between the first connector plate 81 and double end connector plate 111 was made so its leading edge 86 forms a right angle with the double end connector plate 111 to which it is welded and it is planar with the leading edges 86 and 116 of the welded connector plate 81 and double end connector plate 111 such that its unwelded side edge 88 is planar with the unwelded side edge 88 of the first connector plate 81. An inner connector plate 91 is then welded on each side edge 98 to the unwelded side edges of the remaining unwelded side edges 88 of the other two connector plates 81 so it forms a right angle with both connector plates 81, forming a square male insertion adapter 120. Then, a third connector plate 81 is welded longitudinally along its side edge 88 to the side edge 98 of an inner connector plate 91, longitudinally, so that the leading edges 86 and 96 form a right angle and so that said leading edges 86 and 96 are planar with one another. A fourth connector plate 81 is then welded longitudinally along its side edge 88 to the unwelded side edge 98 of the inner connector plate 91 at the side edge 98 opposite where the weld between the connector plate and inner connector plate was made so its leading edge 86 forms a right angle with the connector plate 81 to which it is welded and is planar with the leading edges of the welded connector plate 81 and inner connector plate 91 such that its unwelded side edge 88 is planar with the unwelded side edge 88 of the third connector plate 81. The unwelded end of the double end connector plate 111 is then welded on each side edge 118 to the remaining unwelded side edges 88 of the third and fourth connector plates 81 so it forms a right angle with both connector plates 81, forming an opposing square male insertion adapter 120.

FIG. 13 is a perspective view of a single rear tube coupler shown in FIG. 9 coupled with an upper cross member and upper side member as shown in FIG. 2.

Figure 17:
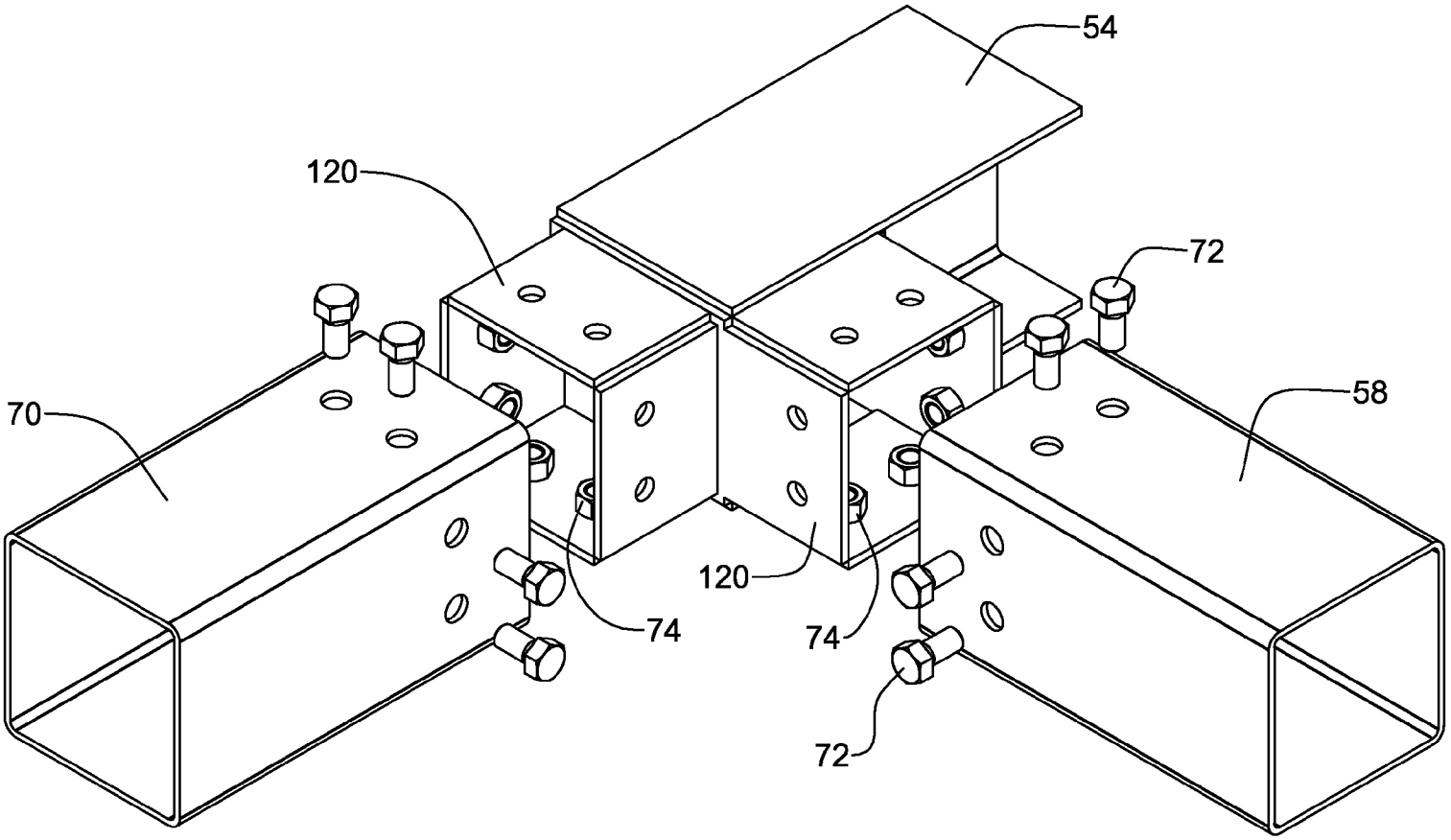
FIG. 17 is a perspective view of a single rear tube coupler which illustrates the joining of a coupler to an upper cross tube member, an upper side member, and an upper linking member.

A single rear tube coupler 80 is used to join an associated upper side member 54 to an associated upper cross member 58 on the landward side of the dock structure module 20. FIG. 13 demonstrates the connection that is made in that circumstance. After the connection is made, there is an exposed male insertion adapter 120 which may be coupled to an upper linking member 70 to enable either two dock structure modules 20 to be positioned with their inward most faces parallel to one another or to affix the upper linking member 70 to a permanent structure, such as a roof, on the landward side of the dock structure module 20 by affixing means. The engagement between the single rear tube coupler 80 and each upper side member 54, upper cross member 58 and upper linking member 70 are made as described in more detail below and as depicted in FIG. 17.

FIG. 14 is a perspective view of a single front tube coupler shown in FIG. 10 coupled with an upper cross member and upper side member as shown in FIG. 2.

A single front tube coupler 90 is used to join an associated upper side member 54 to an associated upper cross member 58 on the waterward side of the dock structure module 20. FIG. 14 demonstrates the connection that is made in that circumstance. The engagement between single front tube coupler 90 and each upper side member 54 and upper cross member 58 are made as described in more detail below as depicted in FIG. 17.

FIG. 15 is a perspective view of a double rear tube coupler shown in FIG. 11 coupled with adjacent upper cross members and upper side member as shown in FIG. 2.

A double rear tube coupler 110 is used to join an associated upper side member 54 to two associated upper cross members 58 on the landward side of the dock structure module 20. FIG. 15 demonstrates the connection that is made in that circumstance. After the connection is made, there is an exposed male insertion adapter 120 which may be coupled to an upper linking member 70 to enable either two dock structure modules 20 to be positioned with their inward most faces parallel to one another or to affix the upper linking member 70 to a permanent structure, such as a roof, on the landward side of the dock module structure 20 by affixing means. The engagement between the double rear tube coupler 110 and each upper side member 54, two upper cross member 58, and upper linking member 70 are made as described in more detail below and as depicted in FIG. 17

FIG. 16 is a perspective view of a double front tube coupler shown in FIG. 12 coupled with adjacent upper cross members and upper side member as shown in FIG. 2.

A double front tube coupler 100 is used to join an associated upper side member 54 to two associated upper cross members 58 on the waterward side of the dock structure module 20. FIG. 16 demonstrates the connection that is made in that circumstance. The engagement between the double front tube coupler 100 and the upper side member 54, two upper cross members 58 and upper linking member 70 are made as described in more detail below and as depicted in FIG. 17.

FIG. 17 is a perspective view of a single rear tube coupler which illustrates the joining of a coupler to an upper cross tube member, an upper side member, and an upper linking member.

Similar to what is shown in FIG. 13, FIG. 17 depicts a single rear tube coupler 80 with its female receiving adapter 130 connected to an upper side member 54. After the connection between the female receiving adapter 130 and the upper side member 54 is made, there are two exposed male insertion adapters 120. The connection between the female receiving adapter 130 and the upper side member 54 is made by welding the female receiving adapter 130 into the receiving cavity 55 of the associated upper side member. In applications that utilize double rear tube couplers 110, the female receiving adapter 130 of the double rear tube coupler 110 is welded into the receiving cavity 55 of the upper side member 54. In applications where a single front tube coupler 90 or a double front tube coupler 100 are used, the female receiving adapters 130 of the said couplers are welded into the receiving cavity 55 of the associated upper side member 54. Whichever fashion of coupler is used, be it single rear tube coupler 80, single front tube coupler 90, double rear tube coupler 110 or double front tube coupler 100, the female receiving adapter 130 of that fashion of coupler is welded into its associated receiving cavity 53 or 55 before powder coating of the vertical side module 50 occurs so that the welding process does not damage the powder coating. The male insertion adapter 120 that is perpendicular to the upper side member 54 is then inserted into the receiving cavity of an upper cross member 58 and is engaged with the upper cross member 58 by the use of a plurality of standard fasteners sufficient to prevent disengagement by traction. In the preferred embodiment, hex nuts 74 are used to retain hex bolts 72 on all four planar surfaces of the male insertion adapter 120. In the preferred embodiment, two hex nuts 74 and two hex bolts 72 are used on each of the four faces of the male insertion adapter to engage the male insertion adapter 120 with the upper cross member 58. In the preferred embodiment, the hex nuts 74 are welded into the receiving cavity of the coupler being used, whether it be a single rear tube coupler 80, a single front tube coupler 90, a double rear tube coupler 110 or a double front tube coupler 100, because the interior of the coupler is not accessible after assembly. Powder coating is undertaken after the hex nuts 74 have been welded into the couplers. Similarly, the upper linking member 70 is engaged with the male insertion adapter 120 that is collinear with the upper side member 54 using the same mechanism of engagement through the use of hex nut 74 and hex bolt 72 that is used to engage an upper cross member 58.

In the preferred embodiment, the single rear tube coupler 80, upper side member 54, upper cross member 58 and upper linking member 70 are all powder coated before assembly of each of those modular elements so that no weldments are required to be made in order to join the modular elements after powder coating. The design thus results in no damage to the powder coating at the time of engagement of the modular elements thereby significantly extending the expected life of the joint and connection made between the single rear tube coupler 80, upper side member 54, upper cross member 58 and upper linking member 70, and providing a pleasing, finished appearance without need for regular maintenance.

Figure 18:
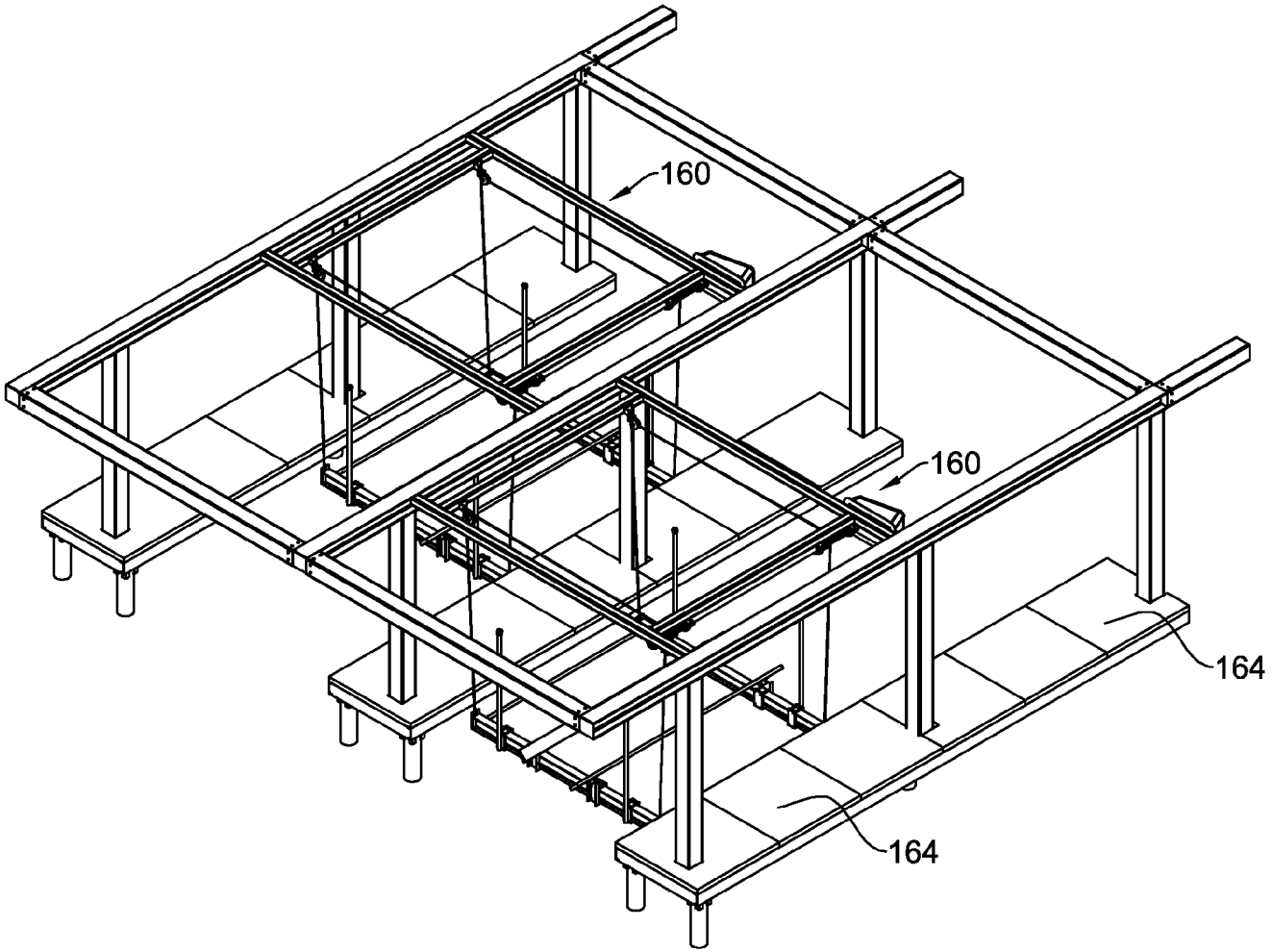
FIG. 18 is a pictorial view of a modular dock structure comprised of two dock structure modules illustrating the use of a movable boat hoist in each dock structure module and lagging atop each walkway module.

FIG. 18 is a pictorial view of an improved modular dock structure comprised of two dock structure modules illustrating the use of a movable boat hoist in each dock structure module and lagging atop each walkway module.

It is desirable to use a boat hoist in conjunction with modular dock structures 10, in general. Each dock structure module 20 of a modular dock structure 10 in the current design is capable of having a boat hoist 160 retained between its opposing upper side members 54. Boat hoists 160 can take on a variety of configurations and are beyond the scope of this invention, but FIG. 18 is illustrative of the environment in which a boat hoist 160 such as that shown can be accommodated. In such applications, the boat hoist 160 will be constructed to be slidably retained by opposing upper side members 54 with engagement of the boat hoist being enabled by the upper and lower flange surfaces of the I-beam 57 and 59 of the opposing upper side members 54. In such applications, the longitudinal location of such boat hoist 160 can be varied by its longitudinal placement along the channel created by the inner lower flange 59 and upper flange 57 of the upper side member 54 where the upper side member 54 is a steel I-beam. In such applications, a boat hoist 160 could be welded or connected with standard fasteners to the opposing upper side members 54 in order to create a secure attachment or could otherwise be joined with the upper side members 54 by other affixing means. Walkway modules 130 can be covered by a variety of materials, as mentioned above, including pre-fabricated concrete lagging 164. Such lagging or other surface may be installed at the time of installation, on site, or before a given walkway module 30 is transported to the construction site.

Figure 19:
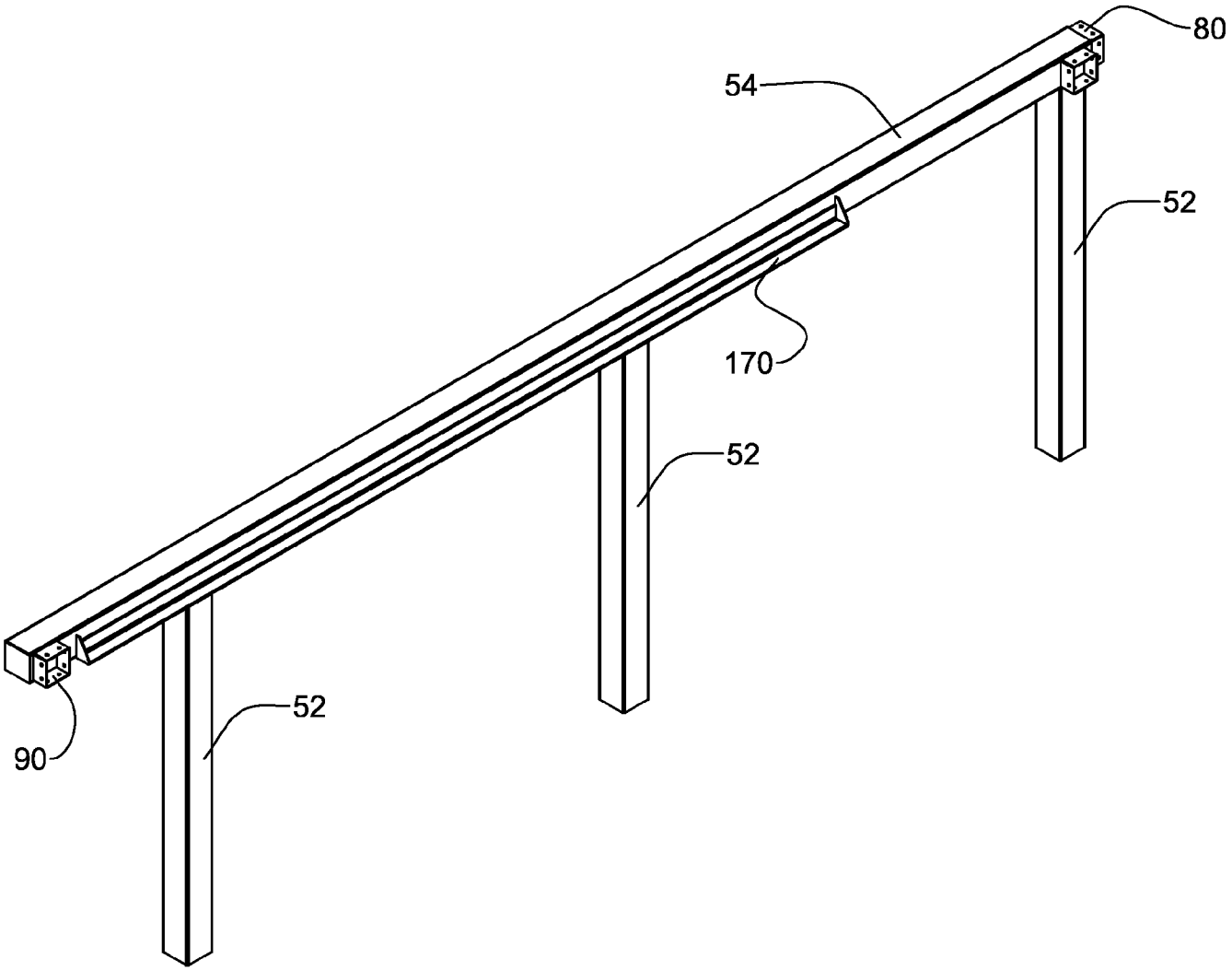
FIG. 19 is a perspective view of an angle iron track for use with a movable boat hoist that may be used with the dock structure module shown in FIG. 2.

FIG. 19 is a perspective view of an angle iron track for use with a movable boat hoist that may be used with the dock structure module shown in FIG. 2.

In another embodiment of the disclosed invention, the upper side member 54 is constructed of steel square tubing instead of a steel I-beam. In such applications, an angle iron track 170 is welded to the interior face of each opposing upper side member 54 to create a track upon which a boat hoist 160 can be slidably retained in the manner discussed above in regard to FIG. 18. In such applications, the angle iron track 170 is welded to the upper side member 54 before powder coating occurs, so that it becomes part of the vertical side module 50.

Figure 20:
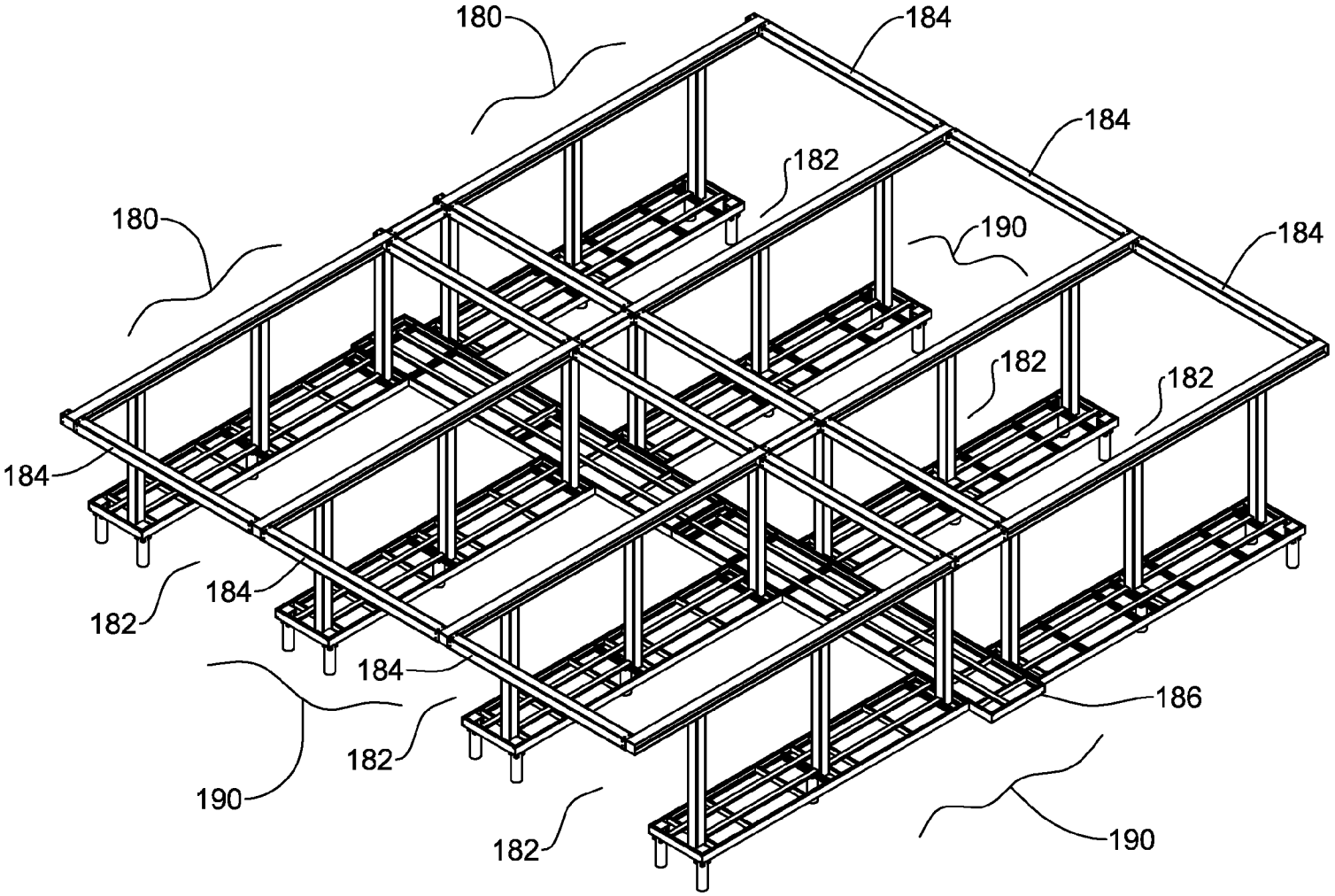
FIG. 20 is a pictorial view of a modular dock structure comprised of a plurality of dock structure modules illustrating the flexibility of configuration of a plurality of the components of the improved modular dock structure; and, FIG. 21 is a perspective view of a piling end cap that may be used with the dock structure module shown in FIG. 2.

FIG. 20 is a pictorial view of an improved modular dock structure comprised of a plurality of dock structure modules illustrating the flexibility of configuration of a plurality of the components of the improved modular dock structure.

In the pictorial representation, an ideal modular dock structure 10 is depicted containing a plurality of dock structure modules 184. In the pictorial representation, the landmass 180 from which the modular dock structure extends is shown. The modular dock structure extends over a body of water 190 and creates a plurality of bays or empty spaces 182 where watercraft can be stationed. The pictorial representation depicts a series of walkway modules 186 that travel perpendicular to the walkway modules of each dock structure module 184 and can be supported by piling driven into the bed of the lake or secured to the opposing walkway modules of each dock structure module 184.

Figure 21:
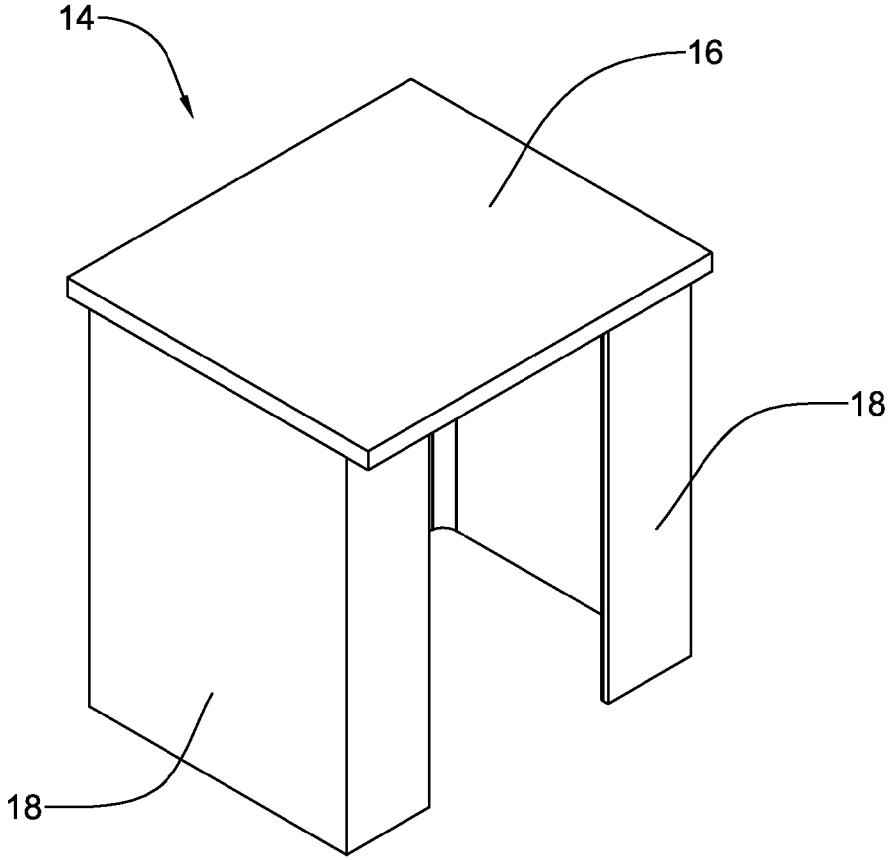

FIG. 21 is a perspective view of a piling end cap that may be used with the dock structure module shown in FIG. 2.

The piling end cap 14 is comprised of a top plate cap 16 and two vertical side retainers 18. The piling end cap 14, in the preferred embodiment, is welded to the vertical piling 12. The top most end of the vertical piling 12 is slotted between the vertical side retainers 18 so that the top most end of the vertical piling 12 fits snugly between the vertical side retainers 18. The top plate cap 16 is flush with the top most end of the vertical piling 12. The piling end cap 14 is then appropriately welded to the vertical piling 12.

The piling end cap 14 is not powder coated. In the preferred embodiment, walkway modules 30 are supported by a plurality of vertical piling 12 which have each been topped with a piling end cap 14. The piling end cap 12 of each vertical piling associated with a particular walkway module 30 are then each welded to the particular walkway module 30 to appropriately support the walkway module 30. The welds made at this location are ultimately covered by decking or lagging panels 164 obscuring the visibility of the welds. In the preferred embodiment, the vertical piling 12, the piling end caps 14 and walkway modules 30 are constructed of steel members thick enough to withstand oxidation and corrosion over the expected life of the dock structure module 20 and modular dock structure 10 so that any damage to the powder coating on the walkway modules 30 is obscured by lagging or other decking atop the walkway modules 30 and is thus not visible to users of the subject modular dock structure 10, while being made of steel of sufficient thickness to outlast the expected lifespan of the modular dock structure 10 in the event of oxidation or corrosion.

As depicted, there are a variety of configurations in which the modular dock structure can be oriented by repetition of the use of a dock structure module 20, such that modular dock structures of virtually unlimited size and orientation can be created such as in the setting of a marina. Likewise, it is evident that the walkway modules can be lined with impact resistant materials (such as a bumper) in order to prevent damage to watercraft coming into contact with the walkway structures and a variety of fixtures, such as anchoring cleats, rings, etc. can be affixed to the walkway modules to enable watercraft to be tied off or otherwise anchored to a walkway module.

The description of the invention is given in its best mode with the presentation of drawings depicting the preferred embodiment of the modular dock structure invention and its basic dock structure module. The invention can be variously arranged to have a variety of embodiments and modes of operation, within the ability of those skilled in the art and without the need of further invention.

I claim:

1. A dock structure module comprising:

a pair of opposing walkway modules spaced apart and supported horizontally above the earth by supporting means, each of said opposing walkway modules affixed by affixing means to an associated vertical side module, with each of said vertical side modules including a plurality of vertical support members, and an associated upper side member having opposing receiving cavities and said upper side member supported by said plurality of vertical support members;

a pair of opposing transverse upper cross members with opposing receiving cavities, coupled at each receiving cavity to opposing upper side members with opposing receiving cavities by a plurality of couplers each capable of coupling the receiving cavity of an upper side member to the receiving cavity of said associated upper cross member;

whereby the said couplers are capable of coupling the receiving cavities of said upper side members and said receiving cavities of said upper cross members without the use of weldments;

wherein the said upper side members are fabricated of steel square tubing of predetermined lengths;

wherein said upper side members include opposing angle iron tracks affixed to said opposing upper side members, said angle iron tracks having a support surface for slidably retaining a boat hoist.

2. A dock structure module comprising:

at least two walkway modules spaced apart and supported horizontally above the earth by supporting means and having a plurality of receiving cavities for receiving an associated vertical side module;

at least two vertical side modules including a plurality of vertical support members having an upper most end and a lower most end and further including an associated upper side member perpendicular to said plurality of vertical support members, said upper side member having opposing receiving cavities and an underside;

means of affixing the said upper most ends of the said vertical support members to the underside of the said associated upper side member;

means of affixing the lower most ends of the said plurality of vertical support members to the said plurality of receiving cavities of the said at least two walkway modules;

at least two upper cross members each with opposing receiving cavities; said at least two upper cross members each being perpendicular to said upper side members and horizontally planar to said upper side members;

means of coupling the receiving cavities of the said at least two uppercross members to the said receiving cavities of the said opposing upper side members without the use of weldments;

wherein the said upper side members are fabricated of steel square tubing of predetermined lengths;

wherein said upper side members include opposing angle iron tracks affixed to said opposing upper side members, said angle iron tracks having a support surface for slidably retaining a boat hoist.

* * * * *